US005951185A

United States Patent [19]

Kingsford et al.

[11] Patent Number: 5,951,185

[45] Date of Patent: Sep. 14, 1999

[54] FLUID MATERIAL DISPENSER

[75] Inventors: Thaddeus I. Kingsford, Sarasota, Fla.; Volker Schrepf, East Islip, N.Y.

[73] Assignee: Henlopen Manufacturing Co., Inc., Melville, N.Y.

[21] Appl. No.: 09/010,650

[22] Filed: Jan. 22, 1998

Related U.S. Application Data

[60] Provisional application No. 60/036,439, Jan. 28, 1997.

[51] Int. Cl.[6] ..... A46B 11/02

[52] U.S. Cl. ..... 401/99; 401/101; 401/122; 401/129; 401/180; 132/218

[58] Field of Search ..... 401/101, 107, 401/108, 122, 180, 99, 129; 132/218

[56] References Cited

U.S. PATENT DOCUMENTS

| | | | |
|---|---|---|---|
| 3,035,299 | 5/1962 | Gordon et al. | 401/107 |
| 4,572,224 | 2/1986 | Rosenwinkel et al. | 132/88.5 |
| 4,598,723 | 7/1986 | Cole | 132/88.7 |
| 4,609,300 | 9/1986 | Robert | 401/122 |
| 4,617,948 | 10/1986 | Gueret | 132/88.5 |
| 4,671,689 | 6/1987 | Gueret | 401/122 |
| 4,687,364 | 8/1987 | Kingsford | 401/127 |
| 4,810,122 | 3/1989 | Cole | 401/122 |
| 5,054,946 | 10/1991 | Morel | 401/122 |
| 5,061,103 | 10/1991 | Walsh-Smith | 401/122 |
| 5,131,774 | 7/1992 | Katz | 401/101 X |
| 5,349,972 | 9/1994 | Dirksing et al. | 132/218 |

*Primary Examiner*—Steven A. Bratlie
*Attorney, Agent, or Firm*—Cooper & Dunham LLP

[57] ABSTRACT

A mascara dispenser including a pen-shaped body having a reservoir for holding mascara, an applicator retractably carried by the body so as to be movable between a location in the reservoir and a location outside the body, a wiper for the applicator within the reservoir, and a movable member within the reservoir and responsive to the location of the applicator for keeping the wiper out of contact with the applicator during retraction of the applicator into the reservoir and keeping the wiper in contact with the applicator when the applicator is moved out of the reservoir.

20 Claims, 15 Drawing Sheets

10
10a
10b
11
12
14
14a
14b
14c
15
15a
16b 24a
16
42
30d
30c
30e
14
48
14

24a
16
12a
48
50

24a
30d
12a
30e
42
48

24a
30f
30f
42
48

10
48

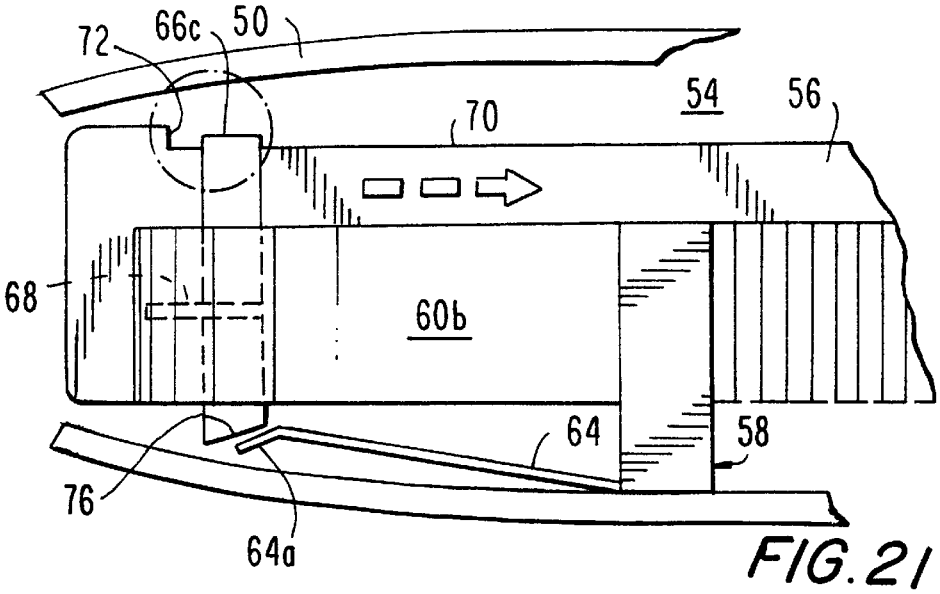
FIG. 21
FIG. 20
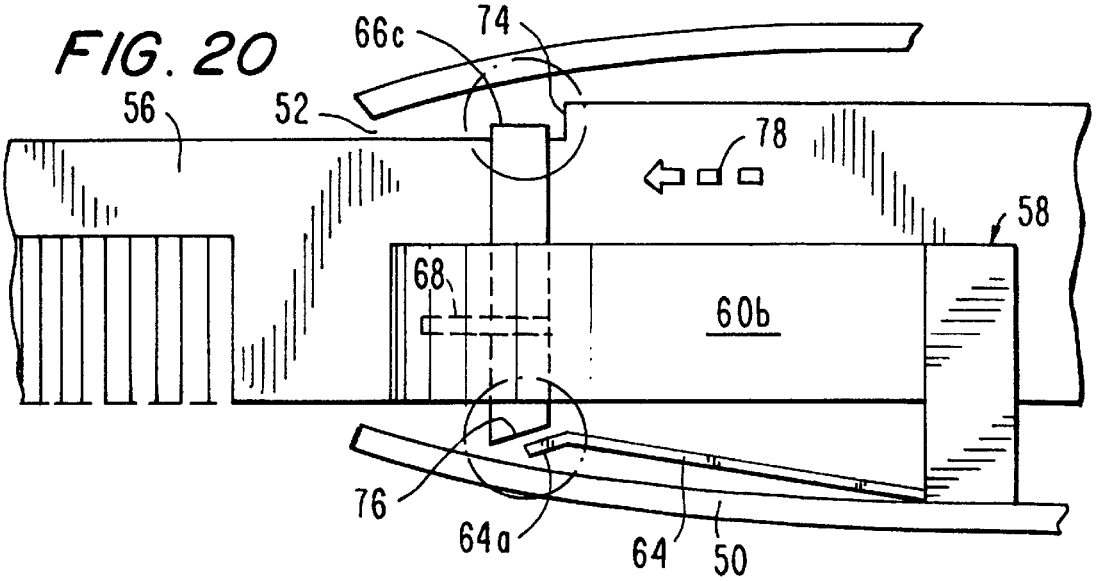
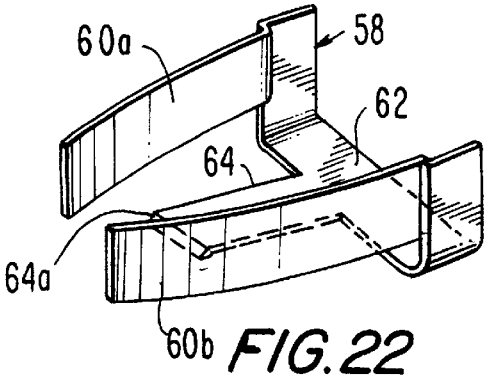
FIG. 22
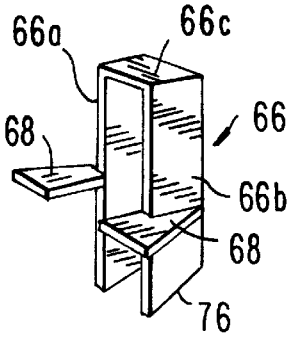
FIG. 23

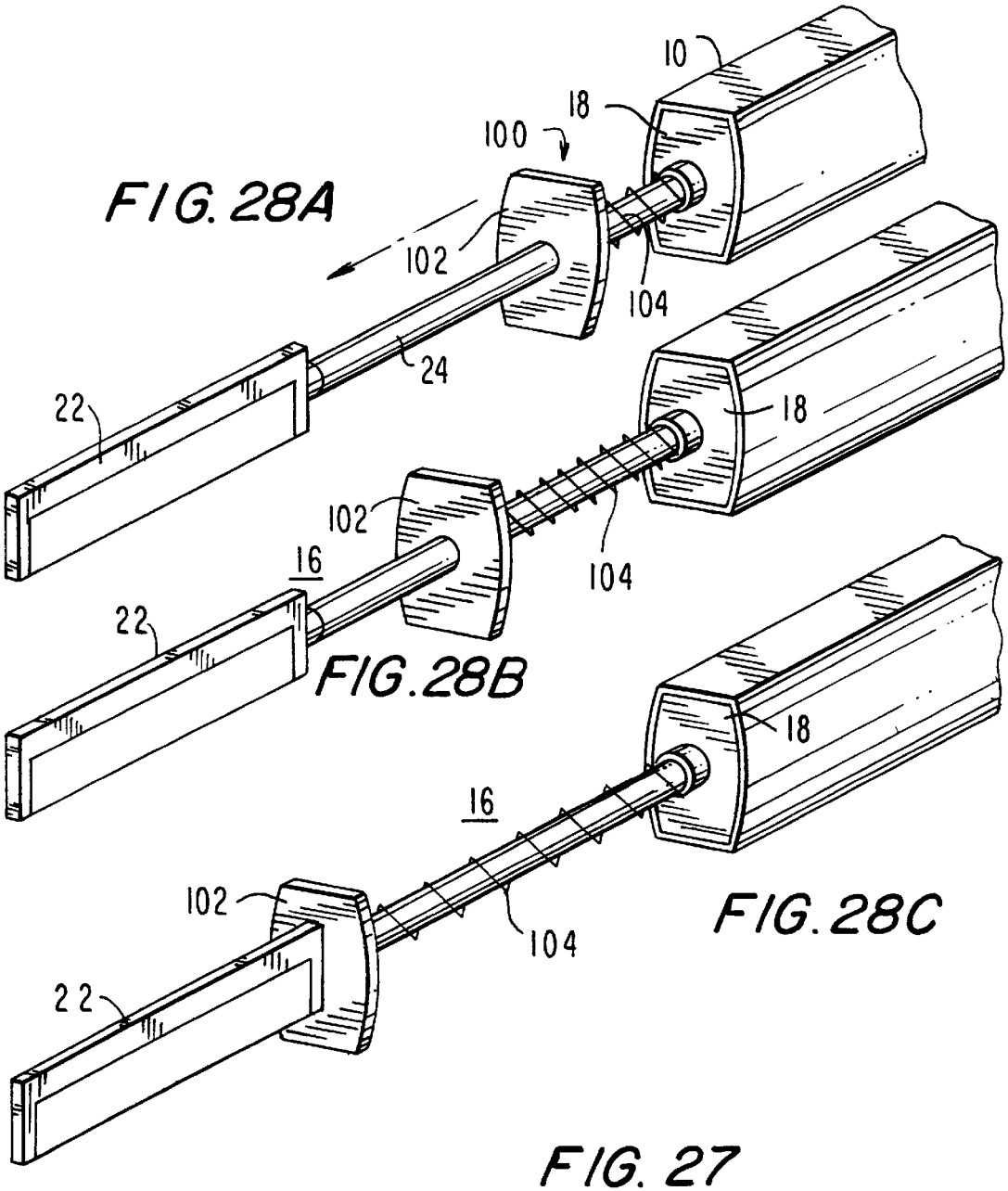
FIG. 28A
FIG. 28B
FIG. 28C
FIG. 27
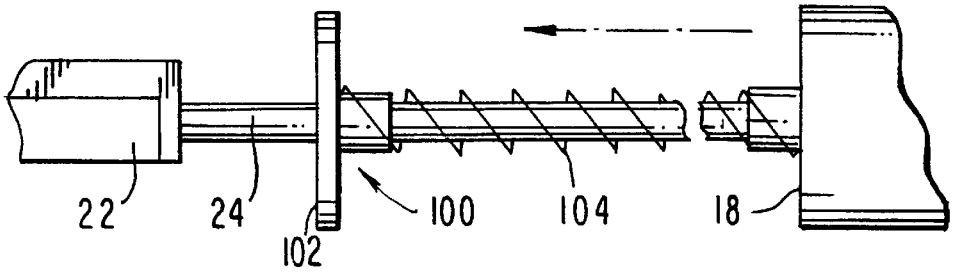

FLUID MATERIAL DISPENSER

CROSS REFERENCE TO RELATED APPLICATION

This application is applicants' U.S. Provisional patent application Ser. No. 60/036,439, filed Jan. 28, 1997, the entire disclosure (including drawings) of which is incorporated herein by this reference.

BACKGROUND OF THE INVENTION

This invention relates to dispensers for fluid material, such as liquid cosmetic products. In an important specific sense it is directed to mascara dispensers, particularly dispensers of the pen type in which an applicator is retractably carried by a pen-shaped body having a reservoir of mascara.

An illustrative pen-type dispenser for mascara is described in U.S. Pat. No. 4,687,364.

As used herein, the term "fluid material" refers to materials which are themselves liquid or incorporate a liquid vehicle, e.g. liquid and pasty cosmetic substances. The term "dispenser" refers to a body defining a reservoir containing a quantity of fluid material such as cosmetic material typically sufficient for a number of repeated applications by a user, and provided with an applicator such as a small brush, comb or the like for transferring and applying to an end-use location (for example, a user's face) fluid material from the reservoir. Such a dispenser is ordinarily dimensioned to be held in the hand and is designed for retail sale to the end user.

A typical present-day mascara dispenser includes a container that holds the mascara, a wiper, a rod to which is attached an applicator (commonly a twisted-in-wire brush), and a closure or cap. The combined length of the rod and applicator is determined by the internal depth of the container. In use, the applicator is moved from the container interior, where it picks up mascara, through a mouth or opening of the container to the exterior, where it is manipulated to apply the mascara, and is thereafter returned to the container interior through the opening.

The wiper, mounted in the container opening for engaging the moving applicator, serves the purpose of controlling the amount of mascara carried on the applicator from the container for use. Its aperture is less than the cross section of the applicator, thus removing (wiping) excess mascara. The cross section of the attached rod, however, is usually smaller than the wiper orifice so as to ease its removal from the container; therefore, the rod usually carries a coating of mascara over its length and periphery.

Because of the nature and density of a typical twisted-in-wire brush, the user seldom applies all of the mascara carried on or within the confines of the brush. Therefore, with every removal and reentry of the brush through the wiper, there is a buildup of residue on the outer side of the wiper; i.e., a reverse wiping action occurs during the return movement of the brush and transfers residual mascara from the brush to the wiper. With usage, an undesirable quantity of mascara collects at the entrance area of the wiper and then transfers onto the rod with each application. This condition is messy and unsightly and may cause smearing on the hands, face or hair of the user; it is prevalent in all mascara dispensers on the market today and is called "backwipe."

An additional difficulty is presented by conventional mascara dispensers wherein the applicator is carried by the cap and is thus fully immersed in the mascara when inserted in the container reservoir. As the applicator is withdrawn from the reservoir, there follows, at the applicator tip, a tail or dollop of mascara. This tail is a problem and a nuisance to the user, in that it is messy (and a hazard to the mascara application) as well as being wasteful. Typically, the user removes the tail with a tissue or brushes it off into the container mouth; in any event, it has to be removed with each repetition of use.

SUMMARY OF THE INVENTION

An object of the present invention is to provide a mascara dispenser with a unique wiping system that opens and closes as necessary and eliminates the condition known as backwipe.

Another object is to provide a mascara dispenser which avoids the formation of a tail of mascara at the applicator tip.

To these and other ends, the present invention in one aspect broadly contemplates the provision of a dispenser for fluid material, comprising a body defining an interior reservoir for holding a quantity of the fluid material, the reservoir having an opening; an applicator for conveying fluid material from the reservoir through the opening to a locality, external to the body, at which it is desired to deliver and apply the fluid material, the applicator being movable from the reservoir forwardly through the opening to an extended location outside the reservoir and rearwardly through the opening to a retracted location within the reservoir; a wiper disposed in the reservoir and having a wiping portion movable into and out of a position for engaging the applicator to wipe excess fluid material therefrom; and structure, including a movable member, disposed within the reservoir for causing the wiping portion to move into and out of its applicator-engaging position, the member being actuated by arrival of the applicator at the retracted and extended locations, respectively, such that the wiping portion is in its applicator-engaging position during forward movement of the applicator from the retracted location and is out of its applicator-engaging position during rearward movement of the applicator from the extended location.

In the described dispenser of the invention, the wiper and movable member are so designed and constructed that the wiping portion wipes the applicator to the appropriate measure for use and then automatically opens the orifice (is disposed away from contact with the applicator) on the return of the applicator for replenishment or closure, so that no excess of mascara is ever collected or transferred during the in and out process of use; thereby, the problem of backwipe is avoided.

In one particular embodiment of a mascara dispenser in accordance with the invention, the applicator used is a comb which is housed within the body of the container. It can be extended or retracted through the wiper opening with the unique opening action described. In this configuration, which resembles a slim pen or pencil, the rod carrying the applicator is never exposed since it remains within the confines of the container and only the applicator moves in and out through the automatic wiper. The same arrangement can be used with other applicators such as a spiral brush, a straight bristle brush, a threaded rod or any variation of these.

The wiping portion conveniently or preferably comprises a pair of resiliently flexible wiping jaws, and the movable member may, for example, be an element carrying the jaws forwardly into or rearwardly away from contact with the applicator. Alternatively, the jaws may be mounted so that they do not undergo any forward or rearward displacement, and the movable member may be an element that advances forwardly to push the jaws away from contact with the applicator and retracts rearwardly to permit the jaws to return to contact with the applicator.

In a second aspect, the invention contemplates the provision of a dispenser for fluid material comprising a body defining an interior reservoir for holding a quantity of the fluid material, the reservoir having an opening; an applicator for conveying fluid material from the reservoir through the opening to a locality, external to the body, at which it is desired to deliver and apply the fluid material, the applicator having an axis and a free tip and being retractably carried by the body so as to be movable along its axis from the reservoir outwardly through the opening to an extended location external to the body, and inwardly to and through the opening to a retracted location within the reservoir, the applicator tip being disposed adjacent the opening when the applicator is in the retracted location; and a wiper disposed in the reservoir in a position for engaging the applicator to wipe excess fluid material therefrom as the applicator moves outwardly through the opening, the wiper being in contact with the applicator adjacent the tip when the applicator is in its retracted location to maintain the tip clean and free of the fluid material, and thereby to avoid formation of a tail of material on the tip. Both of the foregoing aspects of the invention are desirably combined in the same dispenser, so as to prevent both tail formation and backwipe.

In yet a further aspect, the invention contemplates the provision of a dispenser for fluid material comprising a body defining an elongated, axially rectilinear interior reservoir for holding a quantity of the fluid material, the reservoir having a forward end with an opening therein and a rearward wall, and having a substantially uniform cross-section for at least a substantial portion of its length forwardly of the rearward wall; an applicator for conveying fluid material from the reservoir through the opening to a locality, external to the body, at which it is desired to deliver and apply the fluid material, the applicator having an axis and being retractably carried by the body for movement along the axis from the reservoir forwardly through the opening to an extended location external to the body, and rearwardly through the opening to a retracted location within the reservoir, the applicator including a rod extending along the axis through the reservoir from the rearward end thereof; and means for controlling the position of fluid material within the reservoir, such means including a movable wall element through which the rod extends, the wall element being disposed within the reservoir so as to be positioned between the rearward wall and the fluid material in the reservoir and being dimensioned to substantially occlude the reservoir transversely, and a spring under compression between the rearward wall and the wall element for urging the wall element away from the rearward wall with sufficient force to control the reservoir volume available for occupation by the fluid material in correspondence with the amount of fluid material present in the reservoir, but insufficient to expel fluid material through the opening. This aspect of the invention, as well, may be incorporated in a dispenser also embodying the other aspects of the invention discussed above.

Further features and advantages of the invention will be apparent from the detailed description hereinafter set forth, together with the accompanying drawings.

BRIEF DESCRIPTION OF THE DRAWINGS

FIGS. 20 and 21 are fragmentary side elevational views of the forward portion of the embodiment of FIG. 16 illustrating successive stages in the operation of the dispenser;

FIG. 22 is a perspective view of the wiper of the embodiment of FIG. 16;

FIG. 23 is a perspective view of the element for spreading apart the wiper jaws in the embodiment of FIG. 16;

FIG. 27 is a simplified schematic view of a device for controlling the volume occupied by fluid material in a dispenser embodying the invention;

FIGS. 28A, 28B and 28C are simplified perspective views illustrating three different operative positions of the device of FIG. 27 relative to other elements of the dispenser;

DETAILED DESCRIPTION

FIGS. 1–11

Figures 1, 2, 3, 4:
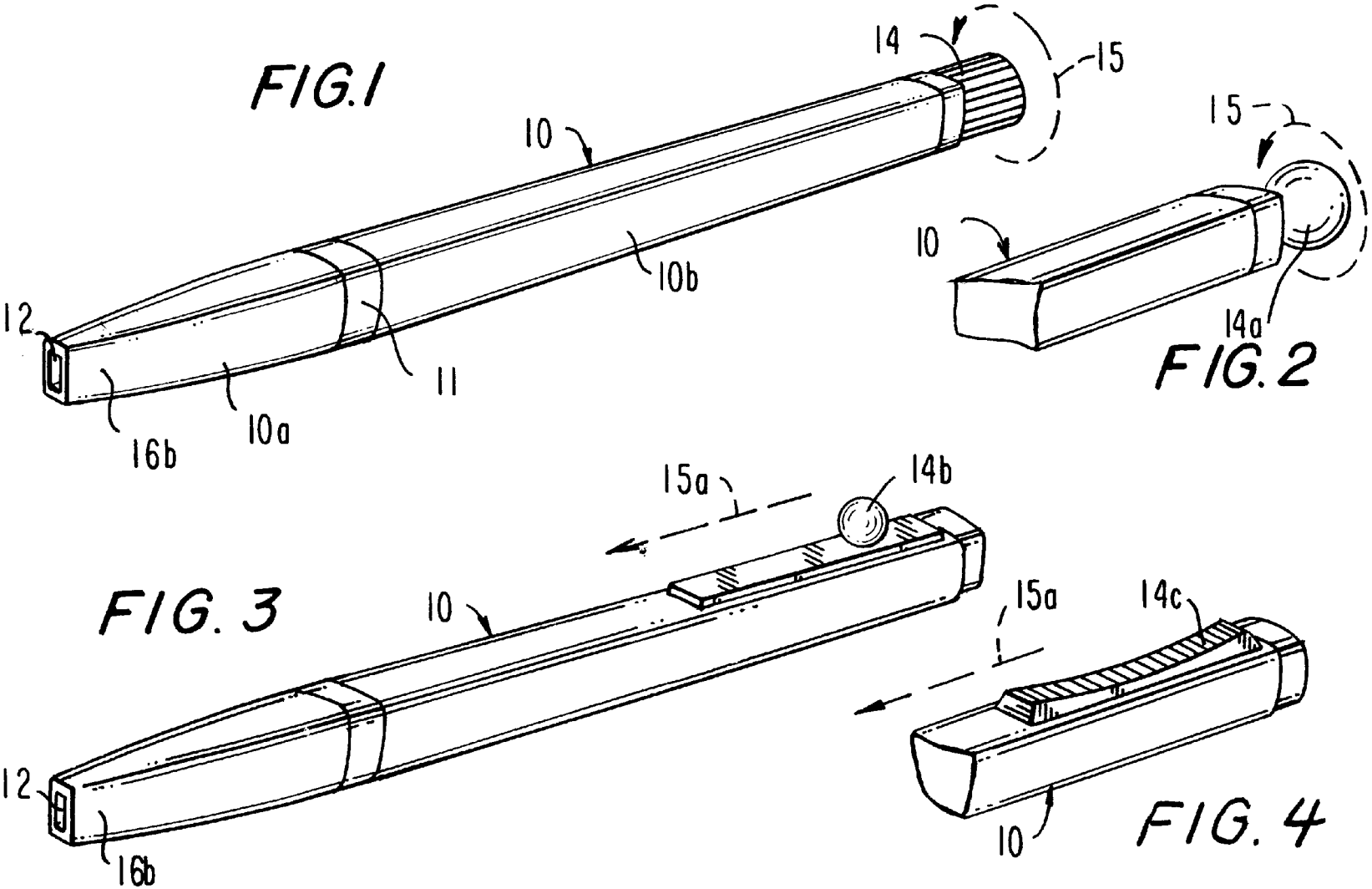
FIG. 1 is a perspective view of a pen-type mascara dispenser embodying the present invention in a particular form.
FIG. 2 is a fragmentary perspective view of a dispenser generally similar to that of FIG. 1 but having an external actuator of modified design.
FIG. 3 is a perspective view of another pen-type mascara dispenser embodying the invention.
FIG. 4 is a fragmentary perspective view of a dispenser generally similar to that of FIG. 3 but having an external actuator of modified design.
Figure 5:
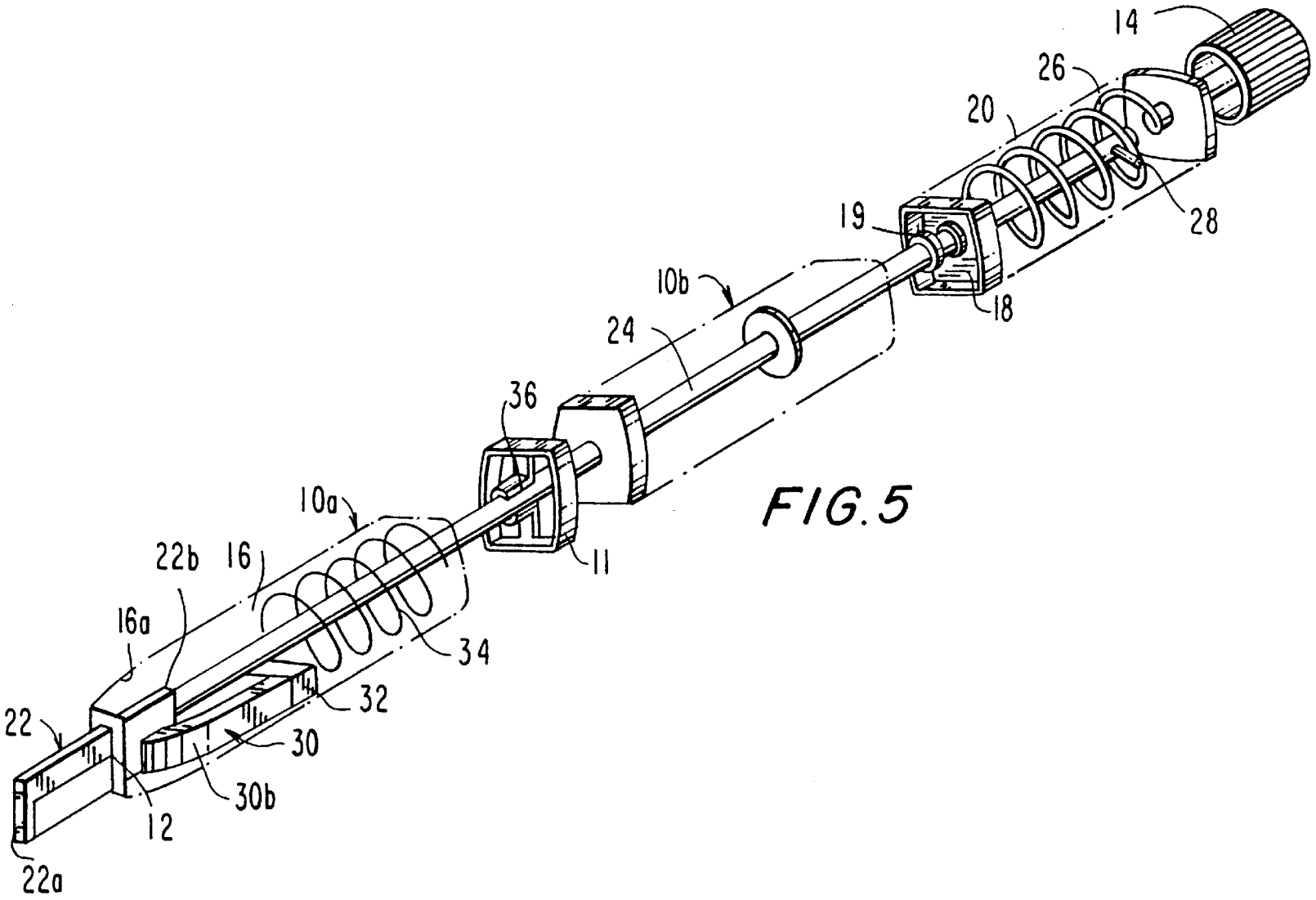
FIG. 5 is an exploded and somewhat schematic perspective view of the dispenser of FIG. 1 with portions of the body wall omitted to show features of internal mechanism.

For purposes of specific illustration, the invention will be described herein as embodied in a pen-type mascara dispenser, an example of which is shown in FIGS. 1 and 5, with design variations shown in FIGS. 2–4. This dispenser includes an elongated and axially rectilinear housing or body 10, generally comparable in shape and dimensions to a writing pen so as to be capable of being carried in a purse or pocket and held in and manipulated by the user's hand for application of mascara. In the specific embodiment of FIG. 1, the body 10 is a hollow, rigid, tubular molded plastic structure, generally square or rectangular in cross-section with rounded corners and constituted of two or more tandem sections 10*a,* 10*b* held together by a joint member 11. At its forward end or nose, the body has a front opening 12 through which a contained applicator (FIG. 5) can be extended from the interior of the body. The rear end of the body is provided with a cylindrical knob 14 (FIG. 1) or a ball-shaped knob 14*a* (FIG. 2) that is rotatable (arrow 15) by the user to operate a helical track mechanism (FIG. 5) to extend or retract the applicator. In place of the helical track mechanism, the applicator may be moved by a slide mechanism having a finger or thumb actuator (14*b,* FIG. 3; 14*c,* FIG. 4) mounted on a side of the rearward portion of the body 10 for movement in the direction indicated by arrow 15*a.*

As shown in FIG. 5, the forward portion of the body 10 defines an internal reservoir 16 for holding a quantity of mascara, e.g. a conventional commercial mascara formulation. The capacity of the reservoir is sufficient for multiple applications to the eyelashes of a user. At its forward end, the reservoir communicates with the front opening 12; the side walls 16*a* and 16*b* of the reservoir converge markedly toward the opening while the top and bottom walls have only a slight forward convergence. At its rearward end (some distance forwardly of the rear end of the body 10), the reservoir terminates in a sealed transverse wall 18 behind which is a separate chamber 20 within the rear portion of the body 10, housing the mechanism for extending and retracting the applicator.

Figure 6A:
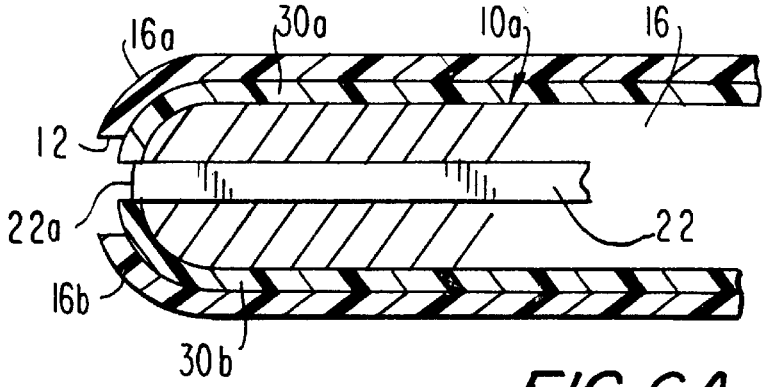
FIGS. 6A, 6B and 6C are enlarged diagrammatic sectional views illustrating the position of the wiper in relation to the applicator comb of the dispenser of FIG. 5 at successive stages in a cycle of mascara application.
Figure 6B:
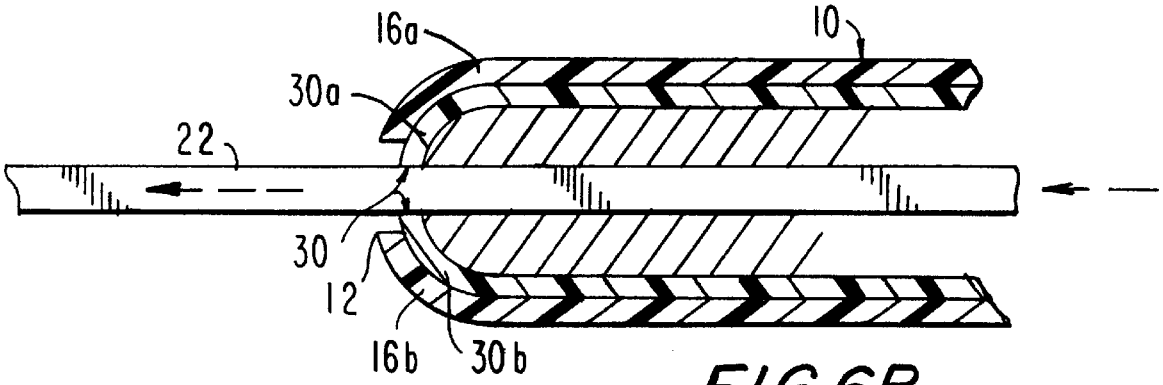
Figures 7A, 7B, 7C, 8:
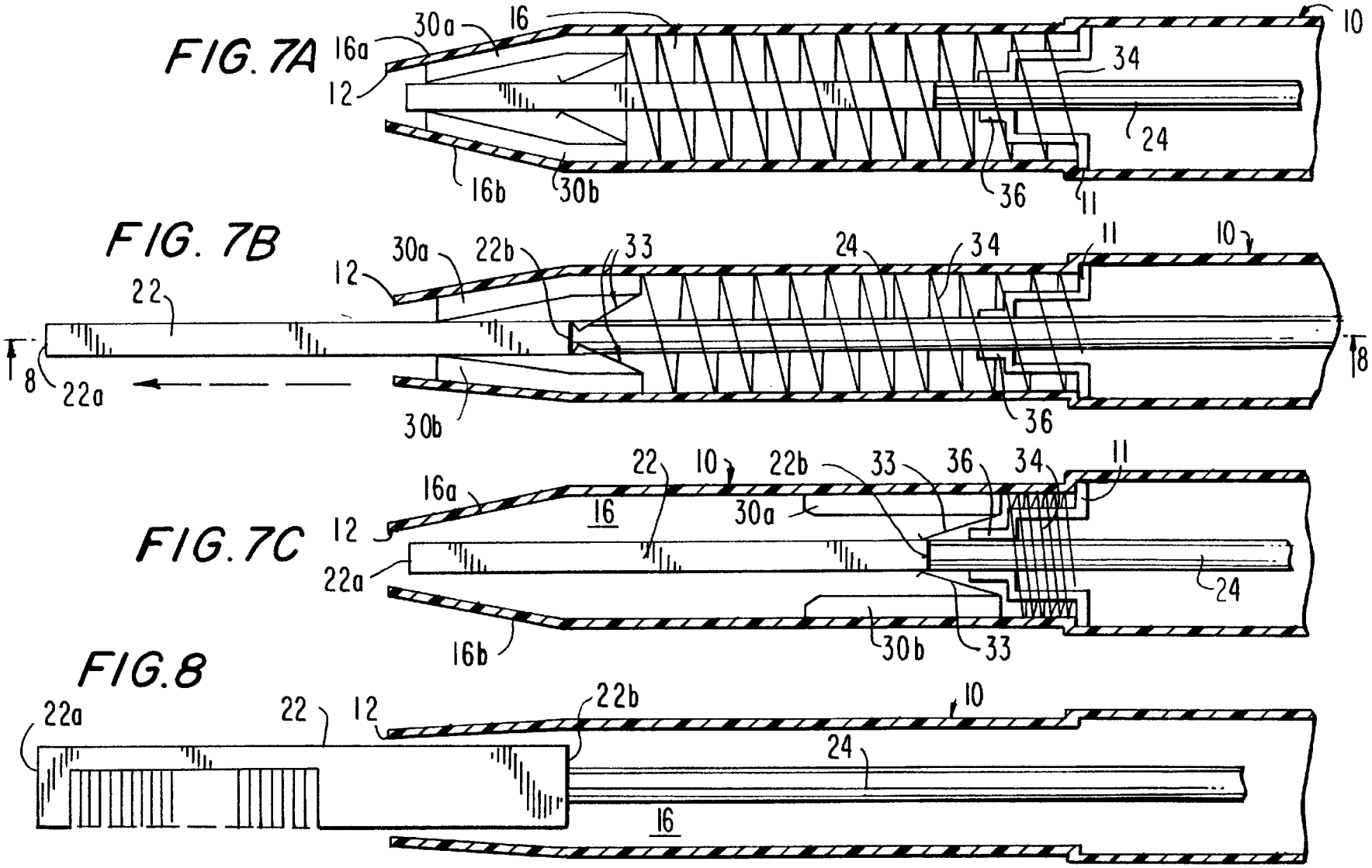
FIGS. 7A, 7B and 7C are diagrammatic sectional views generally similar to FIGS. 6A, 6B and 6C, illustrating the operation of the wiper mounting assembly at successive stages in a cycle of mascara application.
FIG. 8 is a view taken along the line 8—8 of FIG. 7B.

The applicator in this embodiment is a straight, flat comb 22 of molded plastic, mounted at the forward end of a rigid and axially rectilinear rod 24 that extends through substantially the entire length of the interior of the body 10, coaxially therewith. The comb is oriented to pass longitudinally through the opening 12, in the direction of the rod axis, between an extended location at which the comb is substantially fully exposed forwardly of the opening 12 (FIGS. 7B and 8) and a retracted location at which the comb is substantially fully enclosed within the reservoir 16 but with its forward tip 22*a* located adjacent the opening 12 (FIGS. 6A and 7A). The rod 24, secured to the rearward end 22*b* of the comb, is supported within the body 10 by the joint member 11 and the transverse wall 18 for axially directed reciprocating movement relative to the body, so as to extend and retract the comb between these two locations; a sealing O ring 19 surrounds the rod at the point where it passes through the wall 18.

Within the chamber 20 a helical track 26 is mounted for rotation about the axis of the rod 24, and a pin 28 connected to the rod rides in the track 26, which is connected to the external knob 14. When a user turns the knob, the track rotates, causing the pin (and the rod 24 and comb 22 with it) to move forwardly or rearwardly depending on the direction in which the knob is turned; the rod itself does not rotate. If a slide mechanism (FIGS. 3 and 4) is provided in place of the track 26, manual movement of the external actuator 14*b* or 14*c* (which may be fixedly connected to the rod 24 through a fore-and-aft slot, not shown, in the portion of body 10 underlying the actuator) directly moves the rod and comb forwardly or rearwardly.

A wiper 30 with a wiping portion constituted of two resiliently flexible rectangular jaws 30*a,* 30*b* (e.g. made of an elastomer such as Buna rubber or a Buna-like compound) having their rearward ends connected to each other in spaced-apart relation by a plastic or metal retainer 32 is disposed in the reservoir 16 with the two jaws 30*a,* 30*b* respectively extending along the forwardly converging side walls 16*a,* 16*b* of the reservoir. The wiper is slidable forwardly and rearwardly within the reservoir; at its forward limit of travel, the free forward ends of its two jaws (guided inwardly toward each other by the reservoir side walls) are in a position in which they respectively bear against the opposite sides of the comb 22 immediately adjacent the front opening 12 in such manner as to seal the opening 12 in cooperation with the comb and, if the comb is moving forwardly toward its extended location, to wipe the comb for removing excess mascara therefrom.

Figure 9:
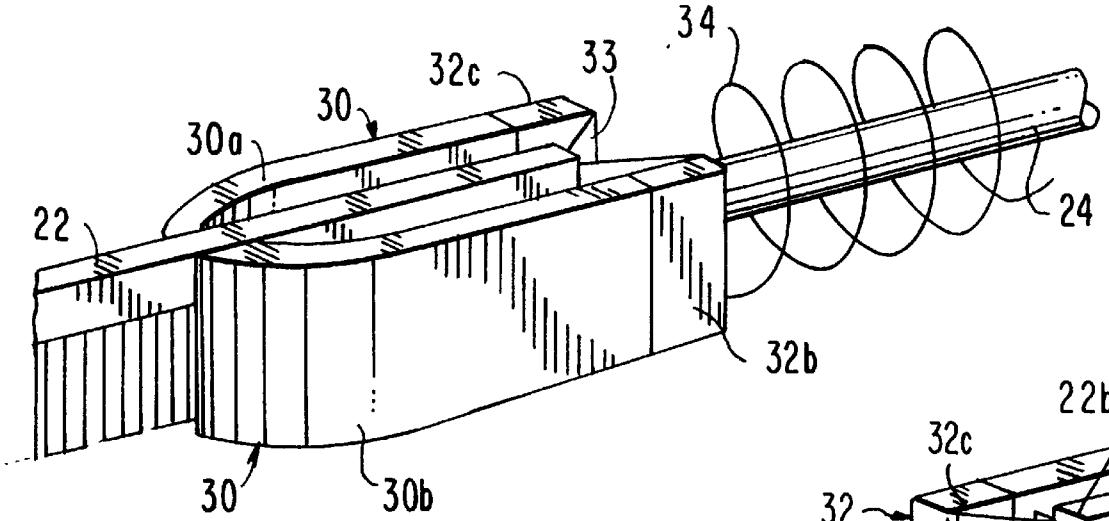
FIG. 9 is a somewhat schematic and further enlarged perspective view of the wiper and comb of the dispenser of FIG. 5, from the front.
Figure 10:
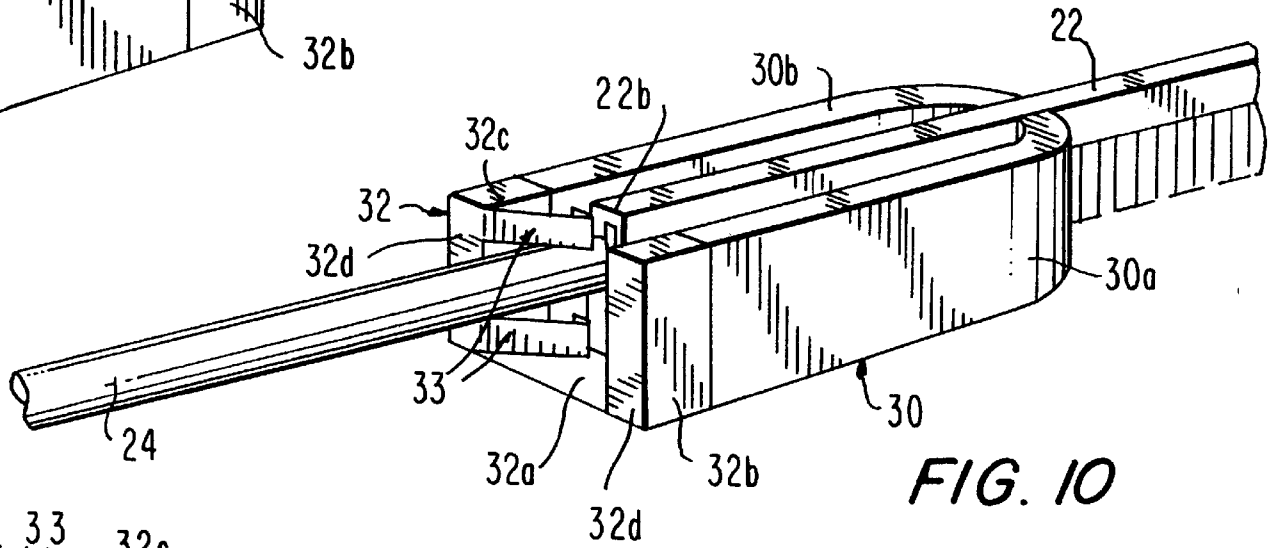
FIG. 10 is a similar perspective view of the same elements, from the rear.
Figure 11:
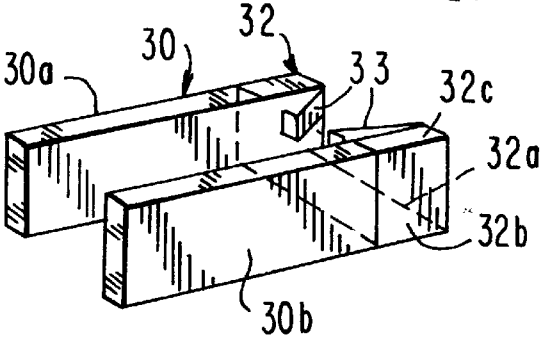
FIG. 11 is a somewhat schematic perspective view of the wiper assembly prior to placement in the reservoir of the dispenser of FIG. 5.

In this embodiment, the retainer 32 serves as a movable member for causing the jaws to move into and out of the position just described. As best seen in FIGS. 9–11, the retainer 32 may, for example, be formed by cutting and bending a sheet metal blank into a shallow U-shape with a web 32*a* and upright arms 32*b* from which top tab portions 32*c* and rear tab portions 32*d* project. The tab portions 32*c* and 32*d* of the two arms 32*b* are folded to cooperate with the arms and web to provide sockets that clamp and hold the rearward ends of the two wiper jaws, while the web 32*a* maintains the jaws in spaced apart relation so as respectively to engage the inner surfaces of the two side walls of the reservoir. From the inner edge of each of the rear tab portions 32*d,* free-ended sheet metal pawls 33 formed integrally with the tab portions 32*d* extend diagonally forward above and/or below the rod 24, the pawls on opposite sides of the retainer 32 converging forwardly toward each other; each pawl is resiliently flexible and terminates at its free forward end in a reverse bend. The dimensions and unstressed angular orientations of the pawls are such that the spacing between the free ends of the converging opposed pawls is less than the thickness of the comb 22, as can be seen in FIGS. 7B and 10.

A helical spring 34 is also disposed in the reservoir 16, under compression between the joint member 11 and the rear tab portions 32*d* of the wiper retainer 32 so as to urge the wiper forwardly within the reservoir, i.e., toward the forward limit of wiper travel. The spring and retainer together constitute a structure for movably supporting the wiper in the reservoir, as hereinafter further described.

When the comb 22 and rod 24 are in the fully retracted location of FIGS. 6A and 7A (such that the comb 22 is within the reservoir 16, immersed in the contained mascara), the helical spring 34 is extended, holding the wiper 30 at its forward limiting position at which the forward ends of the wiper jaws engage and (under the force of the spring) bear against the comb adjacent the forward end 22*a* of the comb. Thereby the wiper and comb cooperatively sealingly close the opening 12 to prevent leakage of mascara or volatile components thereof from the reservoir. In this fully retracted location of the comb, the pawls 33 on the two sides of the retainer 32 respectively bear against opposite side surfaces of the comb, as FIG. 7A shows, being held apart by the thickness of the comb and hence under stress, since they are spaced more widely than they would be in their unstressed position.

As the comb is advanced to the fully extended location of FIGS. 7B and 8 by manual rotation of knob 14, operating the helical track mechanism, it carries mascara with it from the reservoir. The helical spring 34 still holds the wiper 30 at its forward limiting position; thus the wiper jaws remain stationary and engage the sides of the forwardly moving comb, removing excess mascara from the comb as the comb emerges outwardly past the wiper, while cooperating with the comb to prevent leakage from the reservoir through opening 12. Since the free tip 22*a* of the comb is never immersed in the mascara in the reservoir, but is isolated therefrom by the wiper jaws (FIGS. 6A and 7A) when the comb is fully retracted, it cannot carry any "tail" of mascara from the reservoir when the comb moves to the extended position.

The continuing engagement of the wiper jaws with the comb throughout the movement of the comb to its extended location, and while the comb is fully extended, maintains sealing closure of the opening 12 so that mascara cannot leak from the reservoir 16.

As shown in FIGS. 8 and 10, the rear edge 22*b* of the comb 22 extends above and below the rod 24. The dimensions and disposition of the pawls 33, the wiper 30 in its forward limiting position (where it is halted by convergence of walls 16*a,* 16*b*), and the comb 22 at its fully extended location, are such that when the comb reaches the latter location, its rear edge passes forwardly beyond the pawls. At this point the pawls (released from being held apart by the thickness of the comb) spring back to their unstressed positions in which the free forward ends of opposing pawls are spaced by a distance smaller than the thickness of the comb.

Figure 6C:
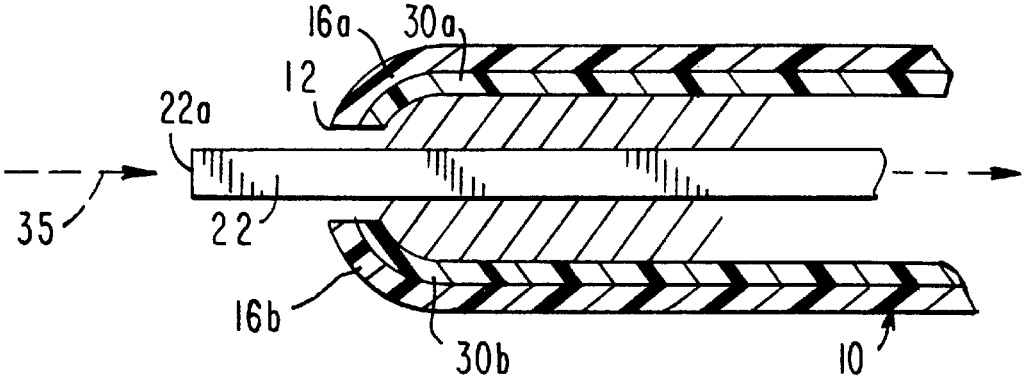

Consequently, as soon as the user begins to retract the comb (by reverse rotation of the knob 14) from its fully extended location, the rear edge 22 of the comb bears against the free ends of the pawls 33 in the manner illustrated in FIG. 7B. Owing to this engagement, progressive retracting movement of the comb (FIG. 6C, arrow 35) pushes the pawls, retainer and attached wiper 30 rearwardly within the reservoir 16 against the force of the spring 34. Since the reservoir side walls are forwardly convergent, the rearward displacement of the wiper causes the forward ends of the resilient elastomeric wiper jaws (which are parallel to each other in their unstressed condition, FIG. 11) to diverge away from contact with the retracting comb, as FIG. 6C shows. The wiper is therefore held away from engagement with the comb throughout the return of the comb to the reservoir, with the result that the undesirable phenomenon of backwipe (transfer of residual mascara to the wiper from an applicator returning to the reservoir) cannot occur.

The joint 11 is formed with a forwardly-projecting sleeve 36 through which rod 24 extends. As will be understood from the foregoing description, during the return or retracting movement of the comb, the pawls remain in engagement with the rear end of the comb; hence the wiper is pushed progressively further backward into the reservoir and the spring 34 is progressively further compressed. The transverse dimension and extent of forward projection of sleeve 36 within the reservoir 16 are such that as the comb reaches a retracted location at or near its rearward limit of retracting travel, sleeve 36 functions as a pawl release, engaging the inner surfaces of pawls 33 and spreading them apart (FIG. 7C) until they are released from engagement with the rear end of the comb. Immediately, the force of compressed spring 34 moves the wiper and retainer forward, and the pawls again bear against the sides of the comb. This release frees the wiper to be driven forward, by continuing expansion of spring 34, back to the forward limiting position of FIG. 7A, where the wiper engages the forward end of the comb and seals the opening 12.

Figure 32:
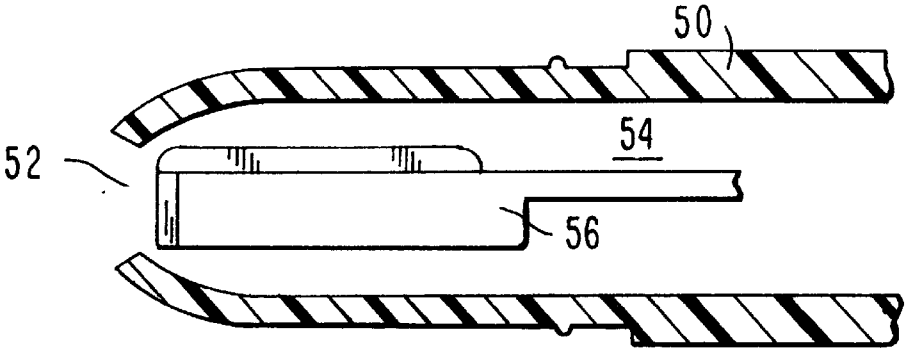
FIG. 32 is a similar view of the forward end of the dispenser body of FIG. 30.
Figure 30:
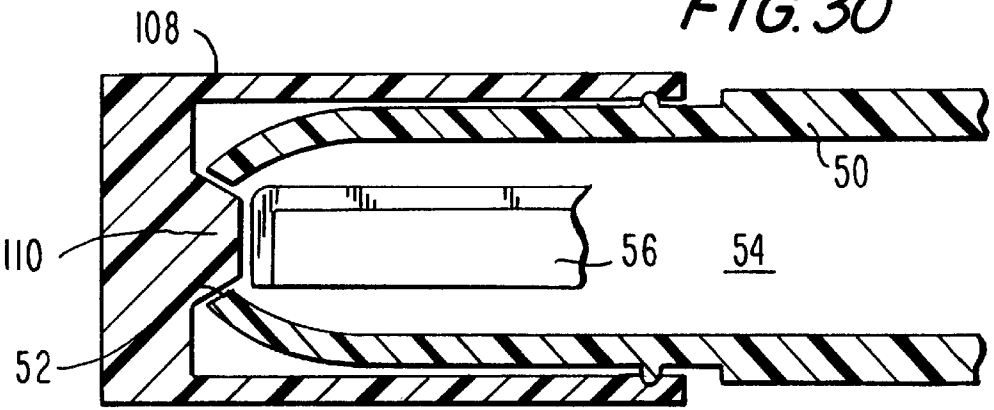
FIG. 30 is a simplified, fragmentary side elevational sectional view of the forward end of a dispenser embodying the invention, showing a cap mounted on the dispenser forward end to sealingly close the opening thereof.
Figure 31:
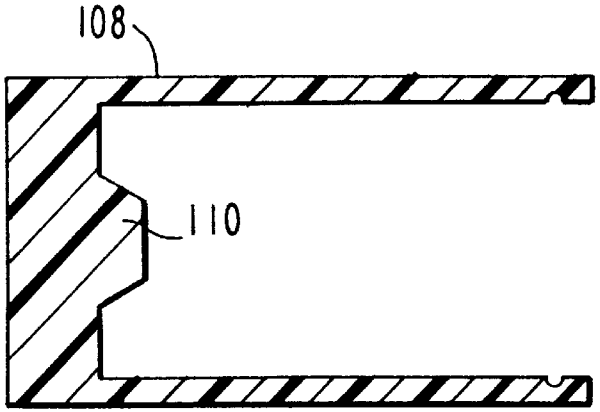
FIG. 31 is a similar view of the cap of FIG. 30.

The operation and use of the dispenser of FIGS. 1–11 may now be readily explained. With a mascara-filled reservoir and the comb in the retracted location of FIGS. 6A and 7A, the dispenser can be stored or carried until an application of mascara is desired. The sealing contact of the wiper jaws with the comb prevents product leakage through the opening 12. Usually the dispenser is provided with a cap, e.g. as shown in FIGS. 30–32 and described below, for covering its forward end.

To apply mascara, the knob 14 is rotated to advance the comb to the fully extended location of FIG. 7B at which the teeth of the comb are fully exposed forwardly of the body 10, as shown in FIG. 8. These teeth bear mascara from the reservoir 16, excess mascara being wiped from the comb by the wiper jaws adjacent opening 12 throughout the forward movement of the comb. The tip of the comb carries no tail of mascara, because it is never immersed in the reservoir but is shielded therefrom by the wiper jaws when the comb is in its retracted location.

The fully extended and mascara-loaded comb is manipulated to apply mascara to the user's lashes, with the body 10 employed as a handle. After such application, the comb is retracted within the reservoir. Throughout its return movement to the reservoir, the comb pushes the wiper jaws rearwardly owing to the engagement of the comb rear end with pawls 33, so that the jaws are maintained out of contact with the comb and the phenomenon of backwipe is avoided. As the comb reaches its fully retracted location, pawl release 36 engages the pawls and spreads them apart, enabling spring 34 to drive the wiper forward into sealing engagement with the front end of the comb adjacent the opening 12, rendering the dispenser ready for storage or reuse.

FIGS. 12A–15E

Although the applicator of the above-described embodiment is a plastic comb, a variety of different types of applicators may be incorporated in the dispensers of the invention. Several examples of alternative applicators are illustrated in FIGS. 12A–E, which are views generally similar to FIG. 1 but with the applicator in extended position.

Figure 12A:
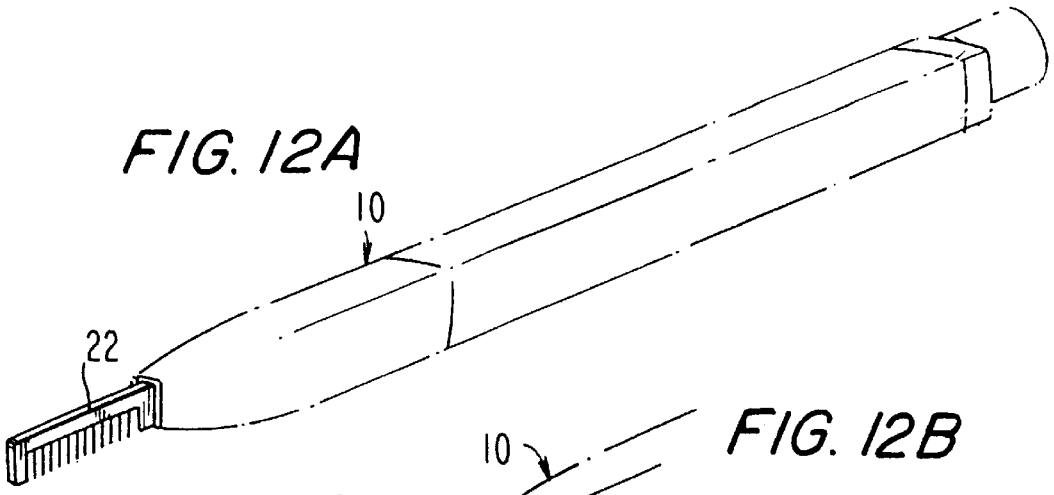
FIGS. 12A, 12B, 12C, 12D and 12E are fragmentary perspective views showing different types of applicators that may be used in dispensers embodying the invention.
Figure 12B:
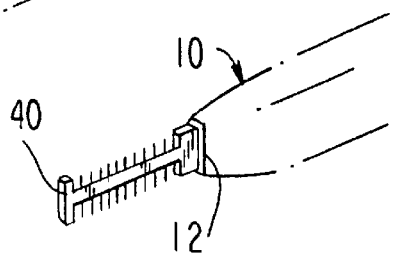
Figure 12C:
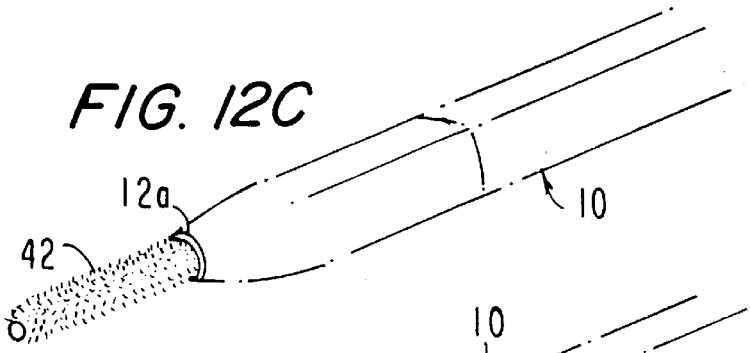
Figure 12D:
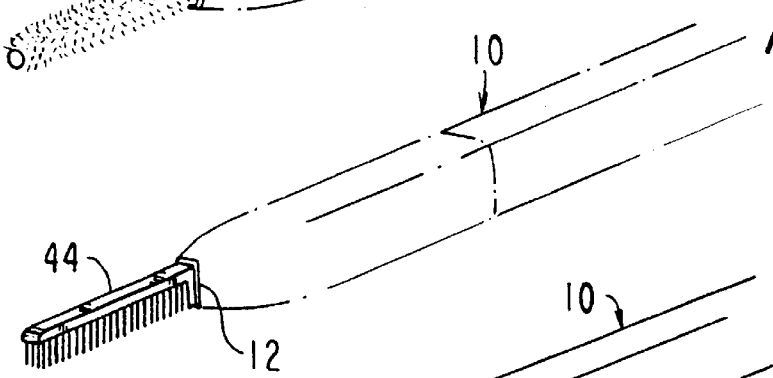
Figure 12E:
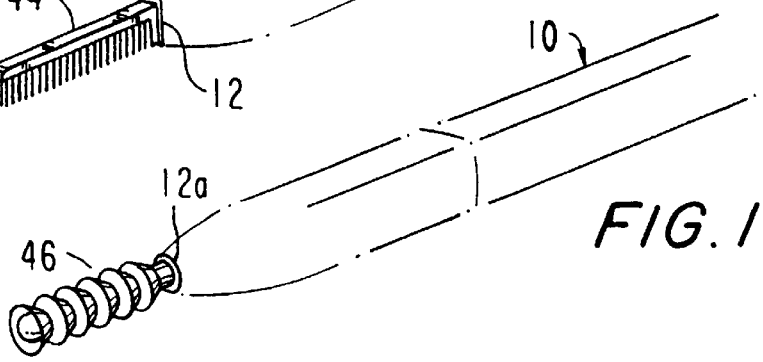

FIG. 12A, for purposes of comparison, shows a dispenser including body 10 with rectangular opening 12 and, as the applicator, the one-sided plastic comb 22 already described. In FIG. 12B, the applicator is a two-sided plastic comb 40 rather than the one-sided comb of FIG. 12A. In FIG. 12C, the comb is replaced with a conventional twisted-in-wire mascara brush 42 of circular or other (e.g. square or triangular) cross-sectional shape; the opening 12*a* in the body 10 is modified in shape to conform to the cross-sectional profile of the brush. A straight bristle brush 44 (which may be one or two-sided) is shown in FIG. 12D, again with a rectangular opening 12 provided in the body 10; and a threaded or serrated plastic rod 46 is shown in FIG. 12E, wherein the body 10 has a circular opening 12*a* to conform to the rod cross-section. As will readily be apparent to persons skilled in the art, where necessary in these modified embodiments, suitable elements can be mounted at or adjacent the rear end of the applicator to perform the functions of cooperating with the pawls of the wiper structure in the same manner as the comb 22.

Additional details of arrangement and operation of an embodiment of the invention employing a cylindrical twisted-in-wire mascara brush are illustrated in FIGS. 13A–13D, 14 and 15A–15E. As there shown, the brush 42 (which in itself may be entirely conventional, as heretofore employed in mascara dispensers) carries a round plastic button 48 on its forward end and is secured at its rear end to a rod 24*a* corresponding to rod 24 of FIGS. 1–11. The wiper 30*c* of the device is generally similar to the wiper 30 of FIGS. 1–11 except that each of the resiliently flexible jaws 30*d* and 30*e* has a semicircular cut 30*f* formed in its leading edge, the two cuts 30*f* together providing a circular aperture 30*g* that conforms to the circular button 48 but is smaller in diameter than the brush 42 so as to provide effective wiping action. By way of example of suitable dimensions, the aperture 30*g*, button 48 and rod 24*a* may all have a diameter of 0.125 inch; the diameter of brush 42 may be 0.1875 inch, with a brush length of one inch; and the diameter of the body opening 12*a* may be 0.3125 inch.

When the brush is fully retracted within the reservoir 16 of the dispenser (FIGS. 13A, 14 and 15C), the wiper jaws are at their forward limiting position. The button 48 is seated in aperture 30*g* and cooperates with the wiper jaws to provide sealing closure of the opening 12*a*.

As the brush is advanced (arrow 50, FIG. 13B) to its extended location outside the body 10 through the wiper aperture 30*g*, the wiper jaws remain in fully forward position, so that excess mascara from the reservoir is effectively wiped off the brush. At the fully extended location of the brush (FIGS. 13C, 15D), the entire brush is forward of the wiper 30*c*, but the wiper jaws, remaining in fully forward position, engage the rod 24*a* rearwardly of the brush to seal the opening 12*a*. It will be noted that since the brush in this embodiment is of circular cross-section, the brush and rod 24*a* may rotate (as indicated by arrows 52, FIG. 15D) about their common axis incident to extension and retraction of the brush.

Retraction of the brush after an application of mascara (FIGS. 13D, 15E) forces the wiper assembly forced away from its forward limiting position, by operation of a movable wiper mounting structure (not shown) corresponding to that of FIGS. 1–11, causing the leading edges of the wiper jaws to move apart away from contact with the returning brush. At or adjacent the rearward limit of brush movement (i.e., the retracted location of the brush), the movable wiper assembly releases the wiper for movement to its forward limiting position where it engages the button of the retracted brush to seal the opening 12*a*.

Figures 13A, 13B, 13C, 13D, 14:
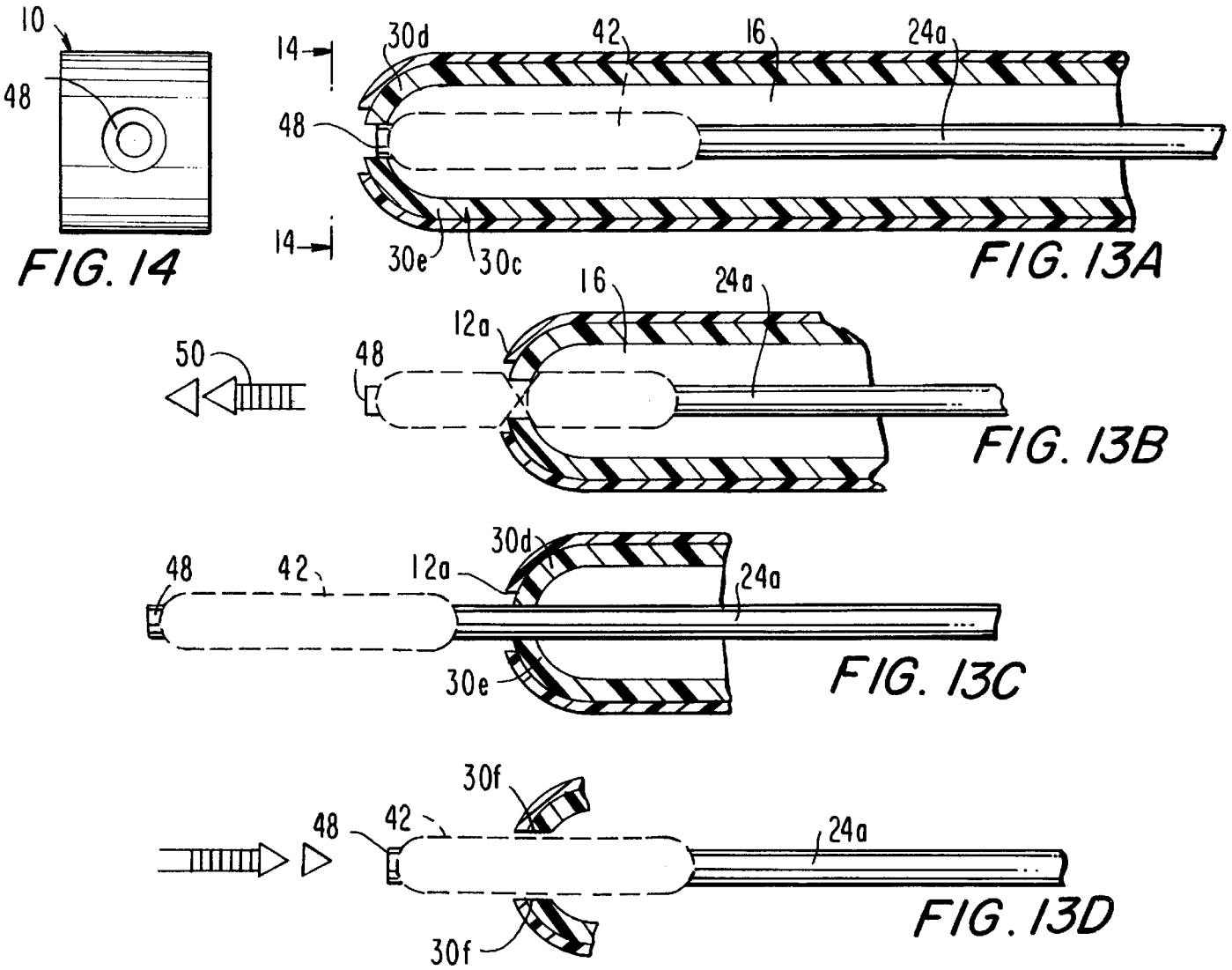
FIGS. 13A, 13B, 13C and 13D are views similar to FIGS. 6A, 6B and 6C illustrating the position of the wiper in relation to an applicator of the type shown in FIG. 12C at successive stages in a cycle of mascara application, in a dispenser embodying the invention.
FIG. 14 is a view taken along the line 14—14 of FIG. 13A.
Figure 15A:
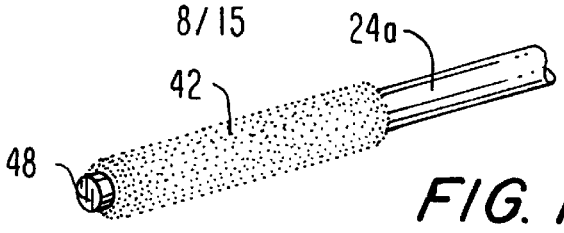
FIGS. 15A, 15B, 15C, 15D and 15E are simplified and somewhat schematic perspective views of the wiper and applicator brush, separately and in operative relation to each other, at various stages in a cycle of mascara application, in the embodiment of FIGS. 13A–13D.
Figure 15B:
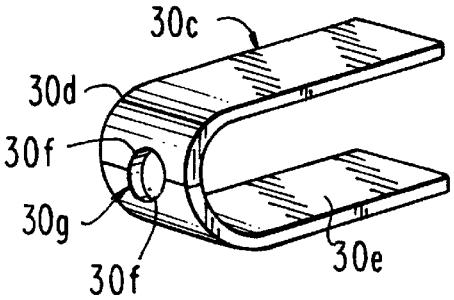
Figure 15C:
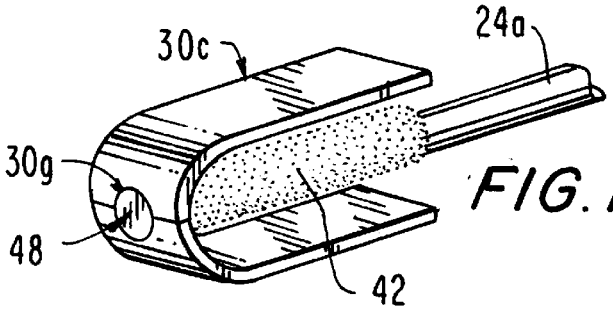
Figure 15D:
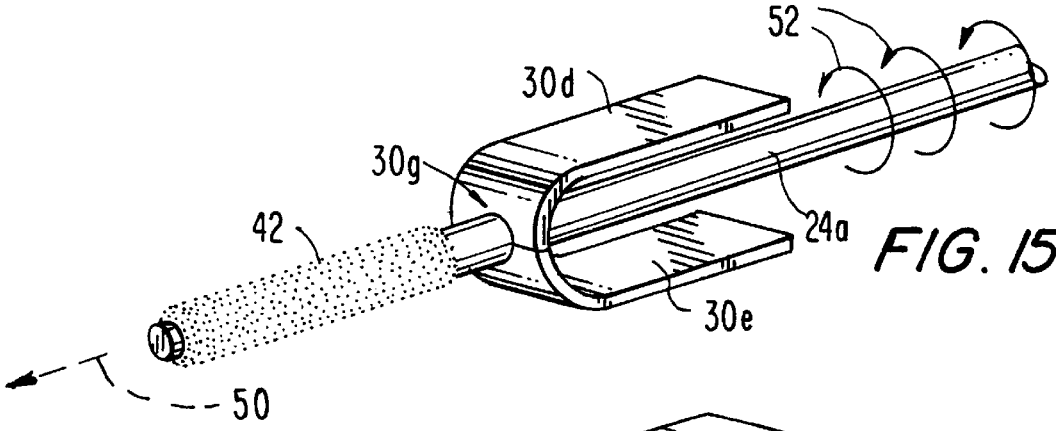
Figure 15E:
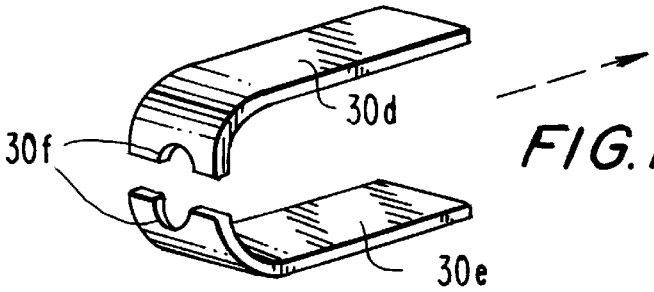

The embodiment of FIGS. 13–15 avoids tail formation and backwipe in the same manner as that of FIGS. 1–11, viz. by keeping the applicator tip isolated from immersion in the mascara reservoir with the aid of the sealing action of the wiper, and by transmitting retracting motion of the applicator to the wiper so as to move the wiper jaws away from contact with the applicator throughout virtually the entire applicator-retracting step.

FIGS. 16–26

The embodiment of the invention illustrated in FIGS. 16–23, like those previously described, is a pen-type mascara dispenser. In common with the embodiment of FIGS. 1–11, it includes an axially rectilinear housing body 50 having a front end opening 52 and defining a reservoir 54 for mascara in its forward portion; and an applicator in the form of a straight, flat comb 56 mounted to be extended forwardly through the opening 52 to deliver mascara to the exterior of the body and to be retracted rearwardly within the reservoir 54 for replenishment and storage. The construction and operation of the housing body and applicator (comb), together with such associated structures as the supporting rod and drive (not shown in FIGS. 16–23) for the comb, may be essentially as described above with reference to FIGS. 1–11.

Figure 16:
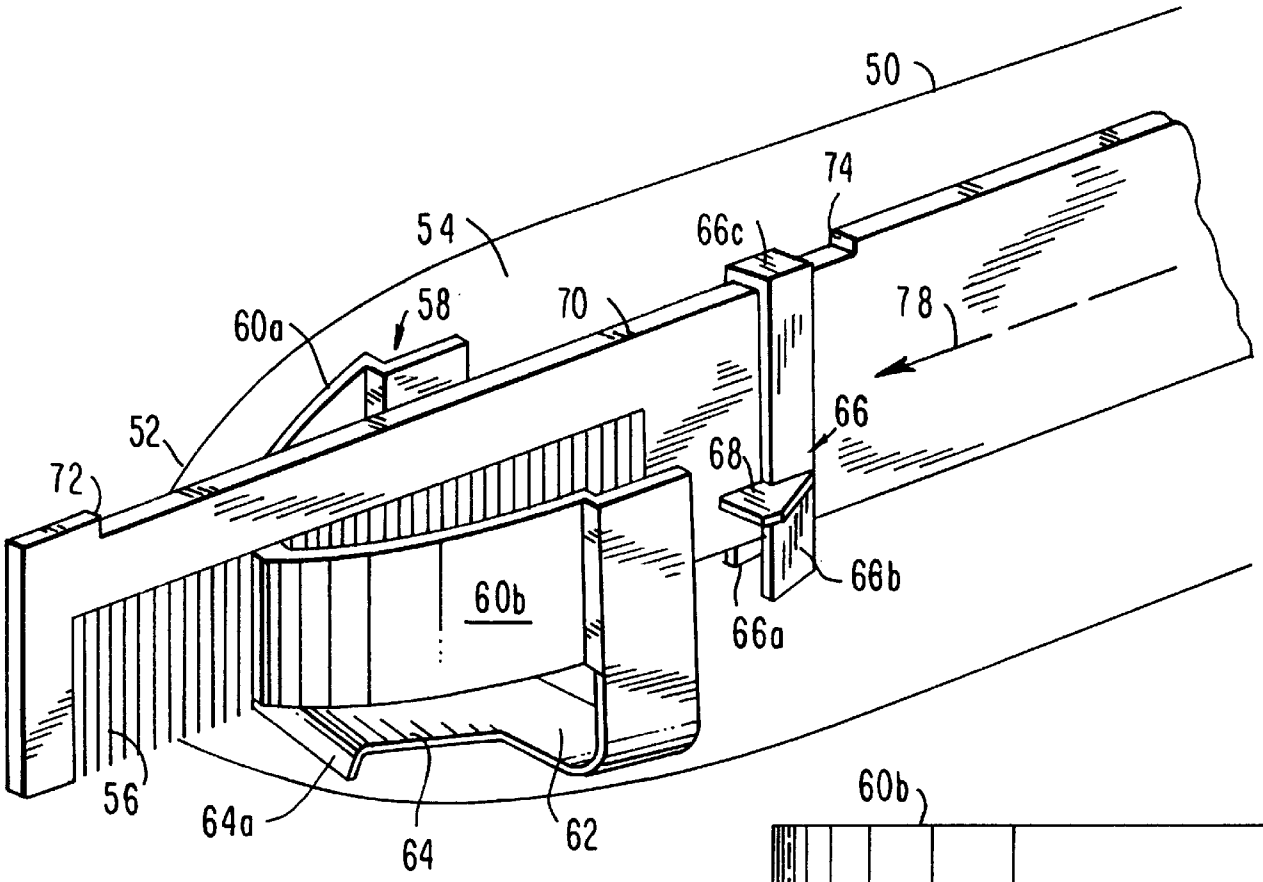
FIG. 16 is a fragmentary perspective view of another mascara dispenser embodying the invention, with the body indicated schematically.
Figure 17:
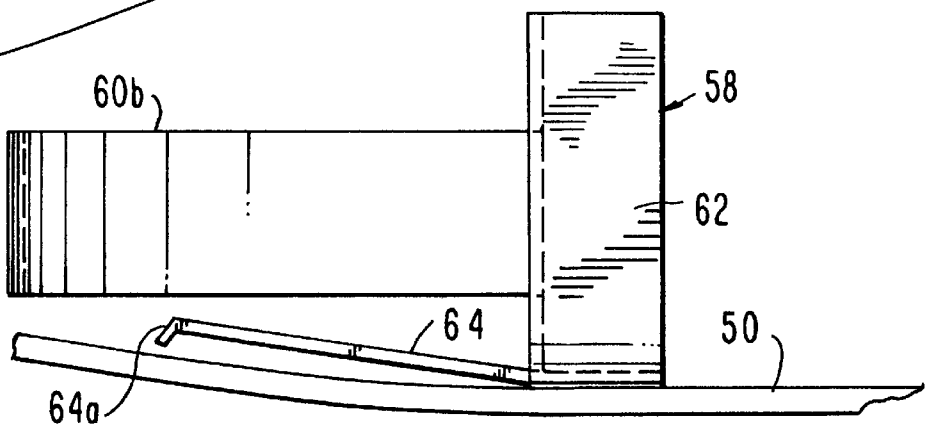
FIG. 17 is a fragmentary side elevational view of a portion of the embodiment of FIG. 16, with the body broken away.
Figure 18:
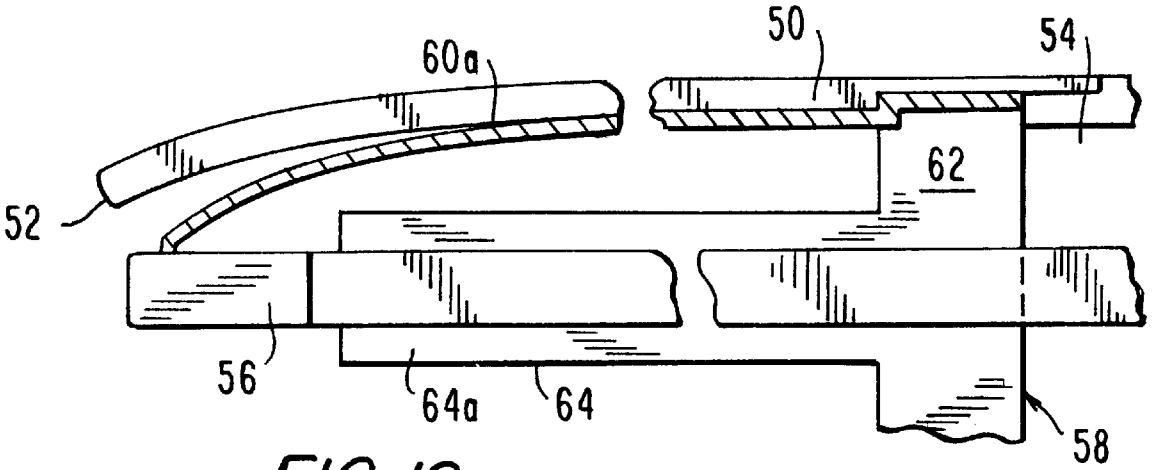
FIGS. 18 and 19 are fragmentary top sectional views of the forward portion of the embodiment of FIG. 16 illustrating successive stages in the operation of the dispenser.

Fixedly anchored within the reservoir 54 of the dispenser of FIGS. 16–23 is a unitary, integral and resiliently flexible wiper component 58, e.g. molded of a suitable plastic or formed of stainless steel. The component 58 has, as a wiping portion, two forwardly projecting resilient jaws 60*a*, 60*b* which converge toward each other on opposite sides of the comb 56 so that in unstressed condition their free forward ends press clamp-like against the opposed major surfaces of the comb at a position (FIGS. 16, 18) adjacent the front end opening 52 of the reservoir, engaging the comb to wipe excess mascara therefrom. A broad U-shaped bridge portion 62 of the component 58 formed integrally with and supporting the jaws is suitably secured within the reservoir to the body 50. From the center of the base of portion 62, a resilient pawl arm 64 (also formed integrally therewith) projects forwardly and slightly upwardly above the floor of the reservoir as seen in FIG. 17, terminating in a reverse bend 64*a* at its free forward end.

Figure 19:
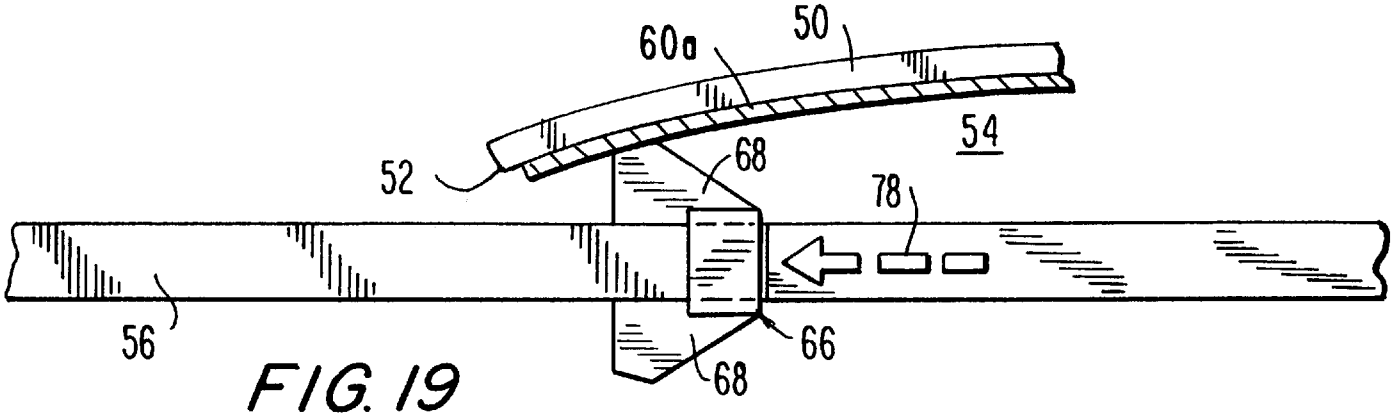

The dispenser of FIGS. 16–23 also includes, as a movable member (or "wiper activator") for causing the jaws to move in and out of their comb-wiping position, an inverted-U-shaped element 66 disposed within the reservoir 54 in straddling relation to the comb for movement back and forth along the long axis of the reservoir. The wiper activator 66, which may be an integral rigid molded plastic element, has two depending legs 66*a*, 66*b* (one on each side of the comb) each bearing, at its midsection, an outwardly projecting wing 68; the legs are interconnected at the top by an integral crosspiece 66*c* extending transversely across the comb. The lateral dimension of the activator 66 including wings 68 is such that the activator can slide freely back and forth along the axis of the reservoir, and the wings are entirely clear of the wiper 58 (for example, with the activator in the position shown in FIG. 16) except when the activator reaches the forward limit of its travel within the reservoir. At the latter point, the wings 68 respectively engage the inner surfaces of the wiper jaws 60*a*, 60*b*, and force the jaws laterally outwardly (as shown in FIG. 19), away from their comb-engaging position. As will be apparent especially from FIG. 19, although the side walls of the reservoir may taper forwardly, in the embodiment of FIGS. 16–23 the reservoir side walls remain far enough apart adjacent the opening 52 so that the jaws 60*a*, 60*b* have room to move outwardly away from wiping engagement with the comb.

The comb, which as stated is straddled by the activator 66, is freely slidable relative thereto over most of its length. However, the top edge of the comb is formed with a long notch 70 having a forward vertical edge 72 and a rearward vertical edge 74. The activator is so dimensioned that its transverse crosspiece 66*c* is received within the notch 70. Consequently, when the comb moves sufficiently far rearwardly (i.e., to its retracted location) relative to the activator 66, the forward vertical edge 72 of the notch interferingly engages the activator crosspiece 66*c* and forces the activator to move rearwardly with further rearward movement of the comb, as shown in FIG. 21. In like manner, when the comb is extended sufficiently far forwardly the rearward edge 74 of the notch engages the activator crosspiece 66*c* and forces the activator to move forwardly in correspondence with further forward movement of the comb to its fully extended location, as shown in FIG. 22.

The lower ends of the legs 66*a* and 66*b* of the activator 66 are bevelled, as indicated at 76, with a forward and downward slope so that when the comb forces the activator to its forward limit of travel (i.e., to the position represented in FIGS. 19 and 22, at which the wings 68 hold the wiper jaws 60*a,* 60*b* out of engagement with the comb), the reverse bend 64*a* of the pawl arm 64 of the wiper component seats against the bevelled bottoms of the activator legs to arrest the activator in the latter position. It will be appreciated that as the activator is dragged forwardly by the comb, the bottoms of the legs 66*a,* 66*b* depress and thus pass over the resilient pawl arm 64, which then springs back behind the legs to engage and hold them. Also, when the comb forces the activator to move rearwardly from this position, the sloping engagement of the legs and pawl arm permits the legs to pass over the pawl arm in a rearward direction, again depressing the pawl arm, so that the activator is released and can be carried by the comb rearwardly out of engagement with the wiper jaws.

In operation of the dispenser of FIGS. 16–23, as the user operates the drive (not shown) to extend the comb 56 forwardly (arrow 78, FIG. 16) out of the reservoir 54 through the opening 52 for application of mascara to the user's eyelashes, the wiper jaws 60*a* and 60*b* in the forward portion of the reservoir are clamped in wiping engagement with the comb and act to wipe excess mascara from the entire tooth area of the comb during travel of the comb to its extended location. At this time, the activator 66 is at a rearward position within the reservoir (as represented in FIG. 16) so that its wings 68 are not in engagement with the resilient wiper jaws; hence, the jaws are free to assume their unstressed, comb-wiping position. The raised "ramp" of the pawl arm 64 deters premature forward movement of the activator, resisting it until the comb is fully extended; and the viscosity of the contained liquid material in the reservoir will, to a minor degree, offer some resistance to activator forward movement as well.

Continuing forward movement of the comb causes the rear edge 74 of the comb notch 70 to engage the crosspiece 66*c* of the activator, thereby moving the activator forwardly with the comb. As the comb reaches its extended location, at which it has been fully wiped along its length by the wiper jaws, the activator arrives at its forward position at which its wings 68 engage and force open the wiper jaws 60*a,* 60*b,* moving them outwardly out of engagement with the comb, while the pawl arm 64 snaps into place against the bevelled bottoms of the activator legs to lock the activator into this forward position.

As the user again manipulates the drive of the dispenser to retract the comb rearwardly into the reservoir for replenishment with more mascara, or storage, the applicator remains locked in the latter position, holding the jaws away from wiping engagement with the comb. In this manner, throughout the retraction of the comb, the undesired occurrence of backwipe is avoided. As the comb finally approaches its fully retracted position, the forward edge 72 of its notch engages the activator and forces it rearwardly, overcoming the retaining force of the pawl arm 64 and thereby releasing the resilient wiper jaws to move again inwardly to their unstressed, comb-clamping or wiping position so that when the comb is next extended out of the reservoir it will again be fully wiped by the jaws.

An advantage of this embodiment, as compared to that of FIGS. 1–11, is that the wiper jaws need be moved (laterally, i.e. outwardly and inwardly) only thousandths of an inch between their wiping and non-wiping positions, whereas in the dispenser of FIGS. 1–11 the whole wiper structure including the jaws typically travels (axially, i.e. rearwardly and forwardly) about 1⅛ inch between those two positions.

Figure 24:
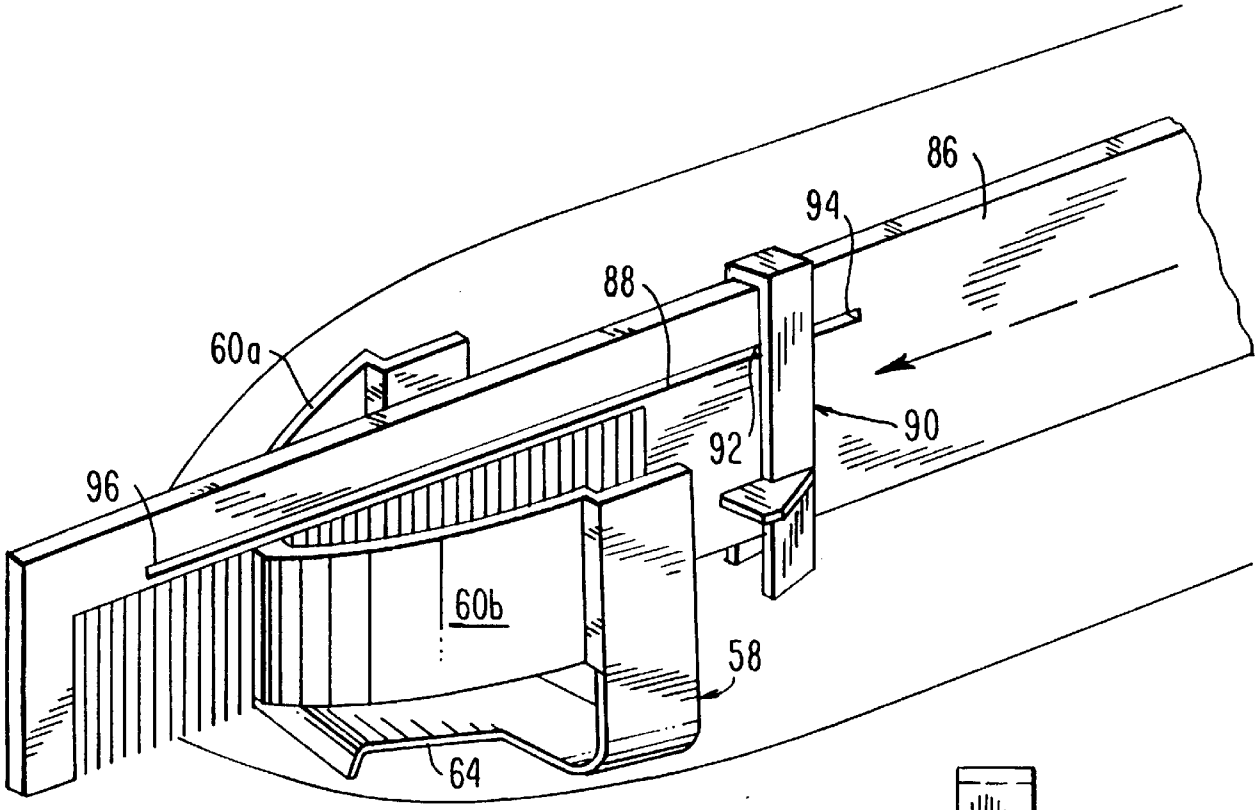
FIG. 24 is a view similar to FIG. 16 of a modified embodiment of the invention.
Figure 26:
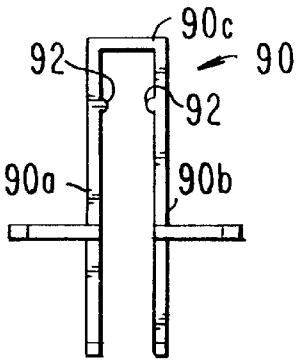
FIGS. 25 and 26 are side and front elevational views, respectively, of the element for spreading apart the wiper jaws in the embodiment of FIG. 24.
Figure 25:
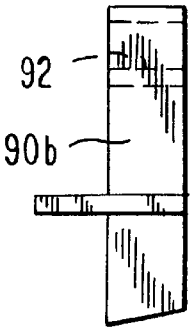
Figure 29A:
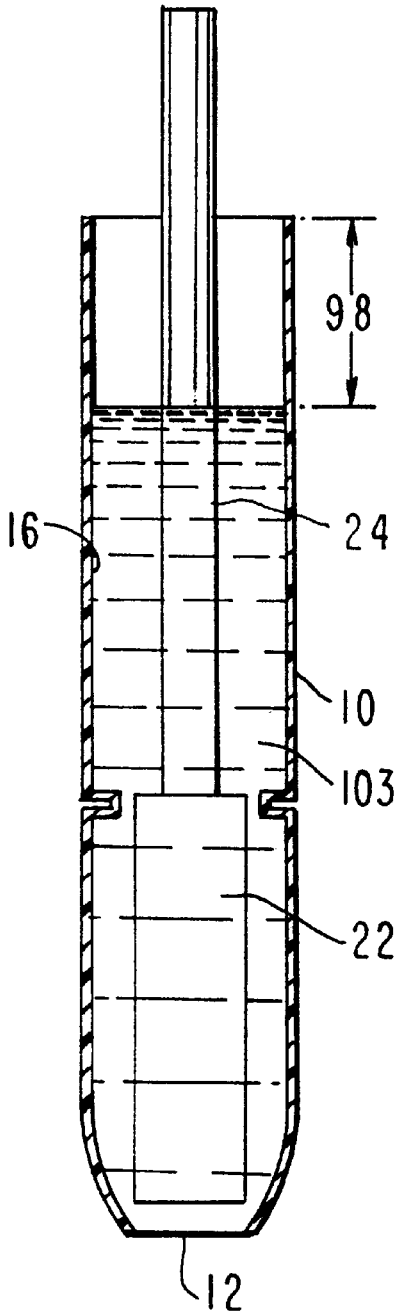
FIGS. 29A and 29B are diagrammatic sectional views in explanation of the operation of the device of FIG. 27.
Figure 29B:
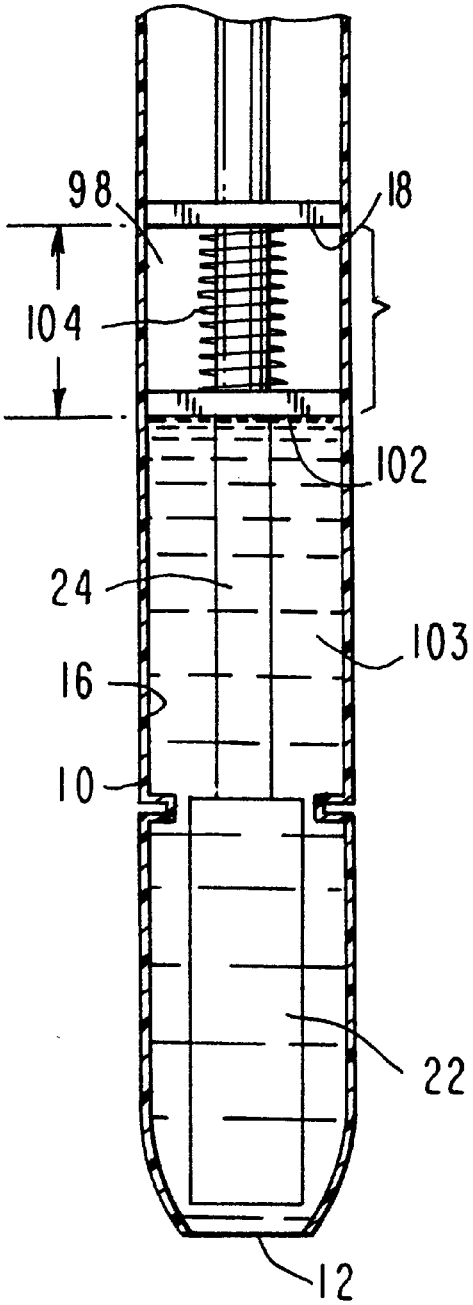

FIGS. 24–26 show a modification of the dispenser of FIGS. 16–23 in which the comb 86 is provided with a longitudinal slot 88 in its upper portion rather than with a notch 70 in its top edge. The activator 90 may be generally similar in structure to the activator 66 of FIGS. 16–23, including legs 90*a,* 90*b* and a top crosspiece 90*c,* but it also has inward projections or beads 92 formed on the inner surfaces of its legs so as to be received within the slot 88. In this structure the crosspiece 90*c* could pass without obstruction over the entire length of the top edge of the comb, but the slot 88 has rearward and forward vertical edges 94, 96 that interfere with the beads 92 to cause the activator to be forced forwardly and rearwardly, respectively, in correspondence with movement of the comb to its extended and retracted locations. That is to say, in the dispenser of FIGS. 24–26, the slot edges 94, 96 and beads 92 perform the same cooperative functions, with respect to positioning and moving the activator in response to movement and location of the comb, as do the notch edges 72, 74 and crosspiece 66*c* in the device of FIGS. 16–23. In all other respects, the dispenser of FIGS. 24–26 may be identical to that of FIGS. 16–23.

FIGS. 27–29B

As shown in FIGS. 27–29B, a pen-type fluid material dispenser embodying the present invention, such as a mascara dispenser, may (as a further particular feature of the invention) be provided with a device for controlling the position of the fluid material within the reservoir of the dispenser. For convenience, this device will be exemplified as incorporated in the dispenser of FIGS. 1–11, but it will be appreciated that such a device can be used in the other dispensers herein described, and indeed in other pen-type fluid material dispensers as well.

In this regard, it may be explained that a pen-type dispenser will commonly lie on its side when not in use, as it has no bottom to stand on, although it is in vertical position when filled with fluid material such as mascara. Typically, in filling procedures, a space (void) 98 (FIG. 29A) of about 10–20% is required. Depending on how the pen-type dispenser lies in or on a drawer or counter, and in what time frame (e.g. overnight, 9 hours more or less), the contained mascara or other fluid material may settle or flow into this 10–20% void. As a result, the comb or other applicator may be denied full exposure to (immersion in) the fluid material. Further, through usage, the void becomes greater and greater. Obviously, this lack of immersion can create a problem for the user; and unlike common present-day types of mascara dispensers, the pen-type dispenser does not enable the user to pump, stir, swivel, etc. the applicator to get mascara on it.

Assuming that in production, the pen-type dispenser will be filled "point" down and, therefore, the comb applicator will be fully immersed, it is desirable that this state remain constant. Accordingly, in the arrangement of FIGS. 27–29B, a spring device 100 is provided to always keep the fluid material (mascara) mass in place and not allow it to flow or move into the 15–20% void space. This device stays constantly in touch with the contained fluid material mass in the reservoir, regardless of its horizontal or vertical attitude. As the mascara (or other fluid material) is removed through usage, the spring device follows it until it is stopped at the rear end of the comb 22—where it is most useful. This spring action is independent of the comb's movement in and out in the reservoir for application of mascara and replenishment or storage; it is an action related only to the position of the contained fluid material mass.

Specifically, the device 100 is used in conjunction with a reservoir 16 having substantially uniform cross-sectional shape and dimensions along at least a substantial part of its length. The device includes a movable pusher or wall element 102 through which the applicator rod 24 extends, the wall element 102 being disposed within the reservoir 16 so as to be positioned between the rearward transverse fixed wall 18 of the reservoir and the fluid material 103 in the reservoir and being dimensioned to substantially occlude the reservoir transversely. Also included in the device 100 is a spring 104 under compression between the rearward wall 18 and the wall element 102, for urging the wall element away from the rearward wall 18 with sufficient force to control the reservoir volume available for occupation by the fluid material in correspondence with the amount of fluid material present in the reservoir, but insufficient to expel fluid material through the front opening 12 of the reservoir.

That is to say, the device 100 operates to contain, but not to push, the fluid volume in the reservoir, preventing the mascara or other fluid material from flowing back into the headspace (void), which enlarges as the dispenser empties. In a 3-inch long mascara chamber, for example, the travel of the spring would typically be about 1½ inches.

FIGS. 30–32

Usually, for each of the above-described embodiments of the pen-type dispenser of the invention, a cap is provided to enclose and shield the nose end of the dispenser at times when the dispenser is not being used to apply mascara. Thus, as shown in FIGS. 30–32, which relate to the embodiment of FIGS. 16–23 for purposes of exemplification, a cap 108, e.g. a unitary molded plastic cap, is provided for seating on the forward end of the body 50, the cap having a hollow interior with a terminal interior projection 110 dimensioned to seat in and close the front-end opening 52 of the dispenser.

It is to be understood that the invention is not limited to the features and embodiments hereinabove specifically set forth, but may be carried out in other ways without departure from its spirit.

What is claimed is:

1. A dispenser for fluid material, comprising:

(a) a body defining an interior reservoir for holding a quantity of the fluid material, said reservoir having an opening;

(b) an applicator for conveying fluid material from said reservoir through said opening to a locality, external to said body, at which it is desired to deliver and apply the fluid material, said applicator being movable from said reservoir forwardly through said opening to an extended location outside said reservoir and rearwardly through said opening to a retracted location within said reservoir;

(c) a wiper disposed in said reservoir and having a wiping portion movable into and out of a position for engaging said applicator to wipe excess fluid material therefrom; and (d) structure, including a movable member, disposed within said reservoir for causing said wiping portion to move into and out of said position, said member being actuated by arrival of said applicator at said retracted and extended locations, respectively, such that said wiping portion is in said position during forward movement of said applicator from said retracted location and is out of said position during rearward movement of said applicator from said extended location.

2. A dispenser as defined in claim 1, wherein said applicator has an axis and is retractably carried by said body so as to be movable along said axis between said extended and retracted locations, and wherein said wiping portion comprises a pair of resiliently flexible wiping jaws respectively disposed on opposite sides of said axis within said reservoir.

3. A dispenser as defined in claim 2, including a manually operable drive carried by said body for moving said applicator along said axis between said extended and retracted locations.

4. A dispenser as defined in claim 3, wherein said applicator has a tip, said tip being disposed adjacent said opening when said applicator is in said retracted position; and wherein said wiping jaws are in contact with said applicator adjacent said tip when said applicator is in said retracted position to maintain said tip clean and free of said fluid material.

5. A dispenser as defined in claim 2, wherein said member movably supports said jaws in said reservoir for displacing said jaws away from and returning said jaws to said position, said member being engaged by said applicator upon arrival of said applicator at said extended location so as to move rearwardly with said applicator and hold said jaws away from said position during rearward movement of the applicator from said extended location.

6. A dispenser as defined in claim 5, wherein said reservoir has opposed walls converging forwardly toward said opening, wherein said jaws respectively engage said opposed walls, said jaws being movable along and guided by said walls toward and away from said opening such that said jaws converge toward each other as they move forwardly toward the opening and diverge away from each other as they move rearwardly away from the opening, and wherein said member movably supports said jaws such that said jaws are caused to move away from said opening upon rearward movement of said applicator from said extended location and are caused to move toward said opening upon arrival of said applicator at said retracted location.

7. A dispenser as defined in claim 6, wherein said member comprises movable retainer means for holding said jaws respectively in contact with said opposed walls; wherein said structure further includes spring means for urging said retainer means in a direction for movement of said jaws toward said opening; wherein said member further comprises pawl means carried by said retainer means and engageable with said applicator when said applicator arrives at said extended location to move said retainer means in a direction opposite to said first-mentioned direction against the force of said spring means upon rearward movement of said applicator from said extended location; and wherein said structure further comprises pawl release means for engaging said pawl means, when said applicator arrives at said retracted location, to displace said pawl means out of engagement with said applicator such that said spring means acts on said retainer means to move said jaws toward said opening.

8. A dispenser as defined in claim 2, wherein said jaws are resiliently biased into said position; wherein said member comprises a slidable element having projections for engaging inner surfaces of said jaws to spread said jaws laterally apart, out of said position, said element being translationally movable along said axis and said applicator having forward and rearward portions for engaging said element so as to move said element forwardly into jaw-spreading engagement of said projections with the jaw inner surfaces upon arrival of said applicator at said extended location and to move said element rearwardly, releasing said jaws from engagement with said element, upon arrival of said applicator at said retracted location; and wherein said structure further includes a pawl for arresting said element when said element is moved forwardly as aforesaid into jaw-spreading engagement of the projections with the jaw inner surfaces and for releasing said element when said element is moved rearwardly as aforesaid.

9. A dispenser as defined in claim 8, wherein said element-engaging portions of said applicator are forward and rearward vertical edges of a longitudinal notch formed in said applicator, said element having a horizontal portion received within said notch.

10. A dispenser as defined in claim 8, wherein said element-engaging portions of said applicator are forward and rearward vertical edges of a longitudinal slot formed in said applicator, said element having a portion received within said slot.

11. A dispenser as defined in claim 2, wherein said applicator is a comb.

12. A dispenser as defined in claim 2, wherein said applicator is a brush.

13. A dispenser as defined in claim 12, wherein said brush is circular in cross-section and each of said jaws has a leading edge with a semicircular cut formed therein, said cuts cooperatively defining a circular aperture smaller in diameter than said brush when said jaws are in said applicator-engaging position.

14. A dispenser as defined in claim 13, wherein said brush has a forward end bearing a button dimensioned to fit sealingly within said aperture such that when said brush is in said retracted location and said jaws are in said applicator-engaging position, said button and said jaws cooperatively sealingly close said opening.

15. A dispenser as defined in claim 14, wherein said applicator further includes a rod dimensioned to fit sealingly within said aperture, said rod having an end at which said brush is mounted, said brush at said extended location lying entirely forwardly of said jaws, and said rod and said jaws cooperatively sealingly closing said opening when said brush is at said extended location.

16. A dispenser as defined in claim 2, for containing and applying mascara, said dispenser further including a quantity of mascara contained in said reservoir.

17. A dispenser as defined in claim 2, wherein said reservoir has a rearward wall and said applicator includes a rod extending along said axis from said rearward wall through said reservoir, and further comprising means for controlling the position of fluid material within the reservoir, said means including a movable wall element through which said rod extends, said wall element being disposed within said reservoir so as to be positioned between said rearward wall and said fluid material in the reservoir and being dimensioned to substantially occlude said reservoir transversely, and a spring under compression between said rearward wall and said wall element for urging said wall element away from said rearward wall with sufficient force to control the reservoir volume available for occupation by the fluid material in correspondence with the amount of fluid material present in the reservoir, but insufficient to expel fluid material through the opening.

18. A dispenser as defined in claim 3, wherein said body is elongated and has a distal end at which said opening is located, and further including a cap for seating on the forward end of the body, said cap having a hollow interior with a terminal projection dimensioned to seat in and close said opening.

19. A dispenser for fluid material comprising:

(a) a body defining an interior reservoir for holding a quantity of the fluid material, said reservoir having an opening;

(b) an applicator for conveying fluid material from said reservoir through said opening to a locality, external to said body, at which it is desired to deliver and apply the fluid material, said applicator having an axis and a free tip and being retractably carried by said body for movement along said axis from said reservoir outwardly through said opening to an extended location external to said body, and inwardly through said opening to a retracted location within said reservoir, the applicator tip being disposed adjacent said opening when the applicator is in said retracted position; and (c) a wiper disposed in said reservoir for engaging said applicator to wipe excess fluid material therefrom as said applicator moves outwardly through said opening, said wiper being in contact with said applicator adjacent said tip when said applicator is in said retracted position to maintain said tip clean and free of said fluid material.

20. A dispenser for fluid material comprising:

(a) body defining an elongated, axially rectilinear interior reservoir for holding a quantity of the fluid material, said reservoir having a forward end with an opening therein and a rearward wall, and having a substantially uniform cross-section for at least a substantial portion of its length forwardly of said rearward wall;

(b) an applicator for conveying fluid material from said reservoir through said opening to a locality, external to said body, at which it is desired to deliver and apply the fluid material, said applicator having an axis and being retractably carried by said body for movement along said axis from said reservoir forwardly through said opening to an extended location external to said body, and rearwardly through said opening to a retracted location within said reservoir, said applicator including a rod extending along said axis through said reservoir from said rearward end thereof; and (c) means for controlling the position of fluid material within the reservoir, said means including a movable wall element through which said rod extends, said wall element being disposed within said reservoir so as to be positioned between said rearward wall and said fluid material in the reservoir and being dimensioned to substantially occlude said reservoir transversely, and a spring under compression between said rearward wall and said wall element for urging said wall element away from said rearward wall with sufficient force to control the reservoir volume available for occupation by the fluid material in correspondence with the amount of fluid material present in the reservoir, but insufficient to expel fluid material through the opening.

* * * * *